US011486244B2

(12) United States Patent
Liu et al.

(10) Patent No.: US 11,486,244 B2
(45) Date of Patent: Nov. 1, 2022

(54) SYSTEMS AND METHODS FOR DETERMINING MUD WEIGHT WINDOW DURING WELLBORE DRILLING

(71) Applicant: Saudi Arabian Oil Company, Dhahran (SA)

(72) Inventors: Chao Liu, Brookshire, TX (US); Yanhui Han, Houston, TX (US); Dung Phan, Houston, TX (US); Younane N. Abousleiman, Norman, OK (US)

(73) Assignee: Saudi Arabian Oil Company, Dhahran (SA)

( * ) Notice: Subject to any disclaimer, the term of this patent is extended or adjusted under 35 U.S.C. 154(b) by 239 days.

(21) Appl. No.: 16/809,464

(22) Filed: Mar. 4, 2020

(65) Prior Publication Data

US 2021/0277762 A1 Sep. 9, 2021

(51) Int. Cl.

| | |
|---|---|
| ***G06F 30/20*** | (2020.01) |
| ***E21B 44/00*** | (2006.01) |
| ***E21B 47/022*** | (2012.01) |
| ***E21B 47/06*** | (2012.01) |
| ***E21B 49/00*** | (2006.01) |

(52) U.S. Cl.

CPC ..... *E21B 44/00* (2013.01); *E21B 47/022* (2013.01); *E21B 47/06* (2013.01); *E21B 49/005* (2013.01); *E21B 2200/20* (2020.05)

(58) Field of Classification Search

CPC ..... E21B 44/00; E21B 49/005; E21B 47/022; E21B 47/06

See application file for complete search history.

(56) References Cited

U.S. PATENT DOCUMENTS

2015/0055438 A1* 2/2015 Yan et al. ..... G01V 1/282 367/73

2019/0368346 A1 12/2019 Liu et al.

OTHER PUBLICATIONS

Chun, K.H. and Ghasseimi, A. ARMA 12-274: "Fracture Propagation under Poroelastic Loading" (Year: 2012).*

Y.Abousleiman et al Time-Dependent Coupled Processes in Wellbore Design and Stability: PBORE-3D SPE 56759 (Year: 1999).*

PCT International Search Report and Written Opinion in International Appln. No. PCT/US2021/020673, dated May 20, 2021, 14 pages.

Abass et al., "Wellbore Instability of Shale Formation; Zuluf Field, Saudi Arabia," presented at the SPE Technical Symposium of Saudi Arabia Section held in Dhahran, Saudi Arabia, May 21-23, 2006, 10 pages.

Abousleiman and Nguyen, "Poromechanics Response of Inclined Wellbore Geometry in Fractured Porous Media," Journal of Engineering Mechanics, vol. 131, No. 11, Nov. 2005, 14 pages.

Abousleiman et al., "Modeling Real-Time Wellbore Stability within the Theory of Poromechanics," AADE-03-NTCE-11, presented at the AADE 2003 National Technology Conference, Practical Solutions for Drilling Challenges, Texas, Apr. 1-3, 2003, 14 pages.

(Continued)

*Primary Examiner* — Andre Pierre Louis

(74) *Attorney, Agent, or Firm* — Fish & Richardson P.C.

(57) ABSTRACT

Systems and methods for determining a time-dependent mud weight window are disclosed. The existence of fractures in formation rock along with a type of the formation rock are used to determine the use of a particular solution to determine the mud weight window at a particular time of a wellbore drilling operation.

25 Claims, 10 Drawing Sheets

(56) References Cited

OTHER PUBLICATIONS

Abousleiman et al., "Time-Dependent wellbore (in)stability predictions: theory and case study," IADC/SPE 62796, presented at the 2000 IADC/SPE Asia Pacific Drilling Technology held in Kuala Lumur, Malaysia, Sep. 11-13, 2000, 8 pages.

Berryman, "Extension of Poroelastic Analysis to Double-Porosity Materials: New Technique in Microgeomechanics," Journal of Engineering Mechanics, vol. 128, No. 8, Aug. 2002, 8 pages.

Cui et al., "Poroelastic solution for an inclined borehole," Journal of Applied Mechanics, vol. 64, Mar. 1997, 7 pages.

Ewy, "Wellbore-Stability Predictions by Use of a Modefied Lade Criterion," SPE Drill and Completion, vol. 14, No. 2, Jun. 1999, 7 pages.

Fjaer et al., "Petroleum Related Rock Mechanics," 2nd Edition, Elsevier Science, 2008, p. 156, 1 page.

Hiramatsu and Oka, "Stress around a shaft or level excavated in ground with a three-dimensional stress state," Mem. Fra. Eng. Kyotu Univ. vol. 24, 1962, 2 pages Abstract.

Jaeger et al., "Fundamentals of Rock Mechanics," 4th Edition, Wiley, 2007, 486 pages.

Liu and Abousleiman, "Multiporosity/Multipermeability Inclined-Wellbore Solutions with Mudcake Effects," SPE Journal vol. 23, No. 5, Oct. 2018, 25 pages.

Liu and Abousleiman, "N-Porosity and N-Permeability generalized wellbore stability analytical solutions and applications," presented at the 50th US Rock Mechanics/Geomechanics Symposium held in Houston, Texas, Jun. 26-29, 2016, 10 pages.

Mehrabian and Abousleiman, "Generalized Biot's Theory an Mandel's Problem of Multiple Porosity and Multiple-Permeability Poroelasticity," Journal of Geological Research: Solid Earth, vol. 119, No. 4, 2014, 19 pages.

Osman and Pao, "Mud Weight Predition for Offshore Drilling," 8 pages.

Warren and Root, "The Behavior of Naturally Fractured Reservoirs," SPE Journal, vol. 3, No. 3, pp. 245-255, Sep. 1963, 11 pages.

* cited by examiner

300

14
12
10
8
6
4
2
304
σ'00 (MPa)
POROELASTIC UNDRAINED
312
ELASTIC (p = p0)
316
ELASTIC (p = pw)
318
308
306
TIME-DEPENDENT
POROELASTIC
SOLUTION
310
POROELATIC DRAINED
314
k = 10-4 mD
k = 10-3 mD
k = 10-2 mD
10-3
10-2
10-1
100
101
102
103
104
105
106
302
TIME (s)

400

1600
1500
1400
1300
1200
1100
1000
900
CRITICAL MUD WEIGHT (kg/m3)
404
ELASTIC (p = p0)
422
414
416
POROELASTIC UNDRAINED
412
POROELASTIC DRAINED
420
ELASTIC (p = pw)
408
406
POROELASTIC UNDRAINED
POROELASTIC DRAINED
410
ELASTIC (p = p0)
418
k = 10-4 mD
k = 10-3 mD
k = 10-2 mD
10-3
10-2
10-1
100
101
102
103
104
105
106
402
TIME (s)

500

18
14
10
6
2
-2
1
2
3
4
5
σ'θθ (MPa)
NORMALIZED RADIAL DISTANCE (r/R)
502
504
506
508
510
POROELASTIC UNDRAIN
DUAL-POROELASTIC UNDRAIN
ELASTIC (p = p0)
POROELASTIC DRAINED
ELASTIC (p = pw)

600

SYSTEMS AND METHODS FOR DETERMINING MUD WEIGHT WINDOW DURING WELLBORE DRILLING

TECHNICAL FIELD

This present disclosure relates to determining a mud weight window during wellbore drilling.

BACKGROUND

During wellbore drilling, drilling mud is used, for example, to provide hydrostatic pressure within the wellbore to prevent incursion of formation fluids into the wellbore during drilling; to provide hydrostatic pressure to prevent collapse of formation rock at the wall of the wellbore; to cool the drill bit; and to flush away drill cuttings. Pressure applied by the drilling mud is monitored and controlled in order to prevent collapse of the formation rock, such as when the drilling mud pressure falls below a collapse threshold, and fracture of the formation rock, such as when the drilling mud pressure exceeds a fracture threshold.

SUMMARY

Some systems and methods for controlling a drilling mud weight include: drilling a wellbore to determine a rock type of a formation rock and the presence of fractures in the formation rock; selecting a drained solution or undrained solution based on the determined rock type and fracture nature of the formation rock; selecting a poroelastic model or dual-poroelastic model based on whether the formation rock includes fractures; selecting a combined solution based on the selected drained or undrained solution and the selected poroelastic or dual-poroelastic model; determining in-situ stresses, pore pressure, and mechanical properties of the formation rock; applying wellbore trajectory parameters, the determined in-situ stresses, pore pressure, and mechanical properties of the formation rock to the combined solution to determine effective stresses; calculating a mud weight window by combining the determined effective stresses with a shear failure criterion and a tensile failure criterion; and controlling a weight of mud used in a drilling operation based on the mud weight window.

Some computer-implemented methods performed by one or more processors for automatically controlling a drilling mud weight include the following operations: determining a rock type of a formation rock and the presence of fractures in the formation rock; selecting a drained solution or undrained solution based on the determined rock type and fracture nature of the formation rock; selecting a poroelastic model or dual-poroelastic model based on whether the formation rock includes fractures; selecting a combined solution based on the selected drained or undrained solution and the selected poroelastic or dual-poroelastic model; determining in-situ stresses, pore pressure, and mechanical properties of the formation rock; applying wellbore trajectory parameters, the determined in-situ stresses, pore pressure, and mechanical properties of the formation rock to the combined solution to determine effective stresses; calculating a mud weight window by combining the determined effective stresses with a shear failure criterion and a tensile failure criterion; and controlling a weight of mud used in a drilling operation based on the mud weight window.

Embodiments of these systems and methods can include one or more of the following features.

In some embodiments, selecting a drained solution or undrained solution based on the determined rock type and fracture nature of the formation rock comprises selecting a drained solution when the rock type of the formation rock is determined to be a conventional rock type.

In some embodiments, selecting a drained solution or undrained solution based on the determined rock type and fracture nature of the formation rock comprises selecting an undrained solution when the rock type of the formation rock is determined to be an unconventional rock type.

In some embodiments, selecting a poroelastic model or dual-poroelastic model based on whether the formation rock includes fractures comprises selecting the poroelastic model when fractures are determined to be absent from the formation rock.

In some embodiments, selecting a poroelastic model or dual-poroelastic model based on whether the formation rock includes fractures comprises selecting the dual-poroelastic model when fractures are determined to be present in the formation rock.

In some embodiments, calculating a mud weight window by combining the determined effective stresses with a shear failure criterion and a tensile failure criterion comprises calculating a time-dependent mud weight window. In some cases, calculating a time-dependent mud weight window comprises using the Drucker-Prager criterion to determine the time-dependent mud weight window.

The details of one or more embodiments of the present disclosure are set forth in the accompanying drawings and the description below. Other features, objects, and advantages of the present disclosure will be apparent from the description and drawings, and from the claims.

DETAILED DESCRIPTION

Figure 1:
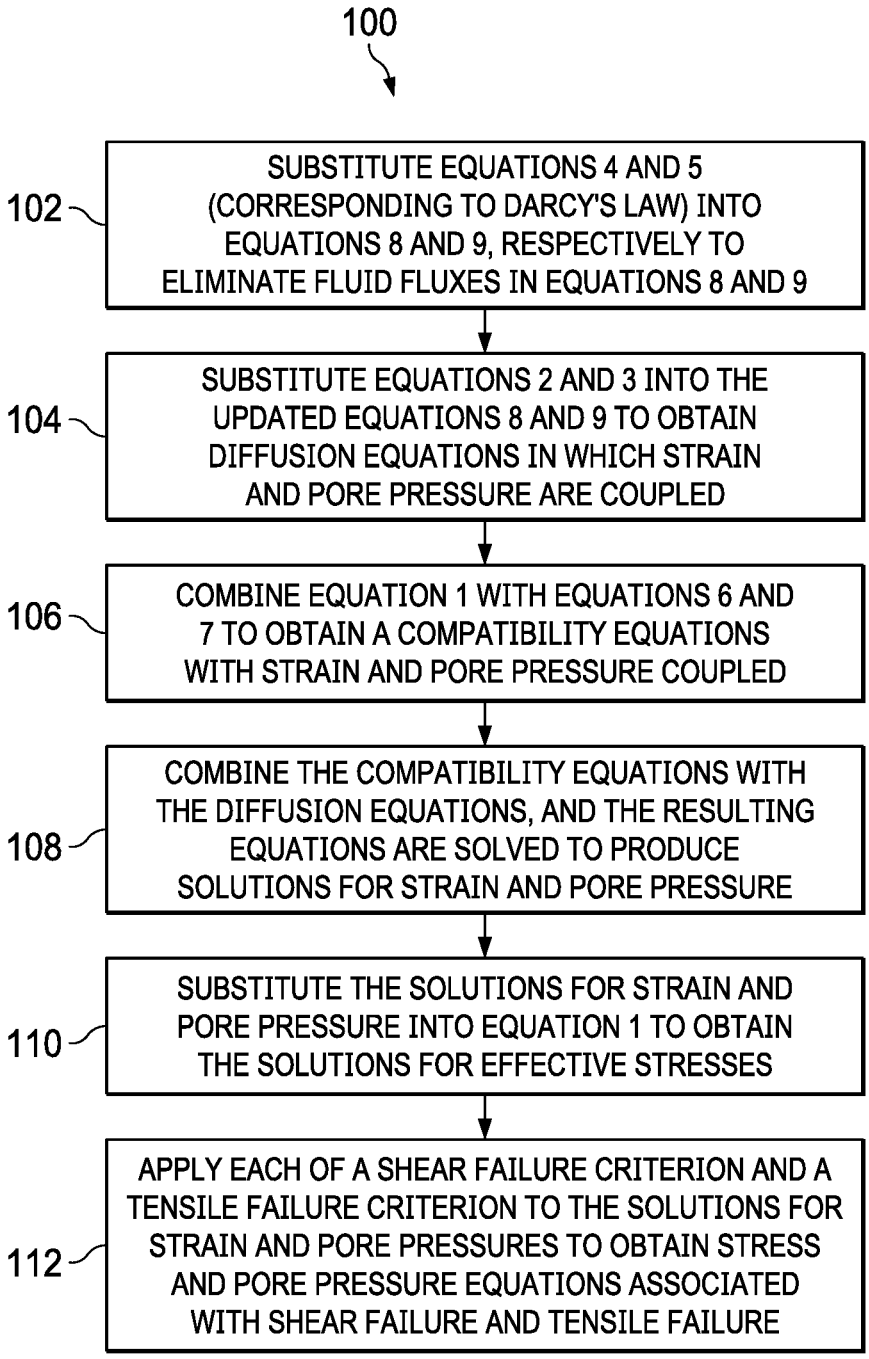
FIG. 1 is a flowchart of an example method for deriving stress and pore pressure equations for drained and undrained solution, according to some implementations of the present disclosure.

For the purposes of promoting an understanding of the principles of the present disclosure, reference will now be made to the implementations illustrated in the drawings, and specific language will be used to describe the same. Nevertheless, no limitation of the scope of the disclosure is intended. Any alterations and further modifications to the described devices, systems, methods, and any further application of the principles of the present disclosure are fully contemplated as would normally occur to one skilled in the art to which the disclosure relates. In particular, it is fully contemplated that the features, components, steps, or a combination of these described with respect to one implementation may be combined with the features, components, steps, or a combination of these described with respect to other implementations of the present disclosure.

The present disclosure provides for determining a mud weight window for drilling mud during the course of a wellbore drilling operation that takes into account time-dependent stress and pore pressure perturbations. Thus, the present disclosure provides methods and associated systems for determining a time-dependent mud weight window based on drained and undrained stress and pore pressure solutions, as opposed to elastic and inelastic solutions. "Drained" is used in the context of rock formations, such as conventional rock formations, that have increased permeability, thereby providing increased fluid flow through the formation rock. In some implementations, conventional rock formation having a permeability greater than or equal to 0.001 millidarcy (mD) may be considered as having an increased permeability. Thus, the drained solution may be used in the context of conventional rock formations having a permeability of 0.001 mD. "Undrained" is used in the context of rock formations, such as unconventional rock formations, that have reduced permeability, thereby providing reduced fluid flow through the rock. In some implementations, unconventional rock formation have a permeability less than 0.001 mD may be considered as having reduced permeability. Thus, the undrained solution may be used in the context of a nonconventional rock formations having a permeability less than 0.001 mD.

Undrained solutions take into account pore pressure perturbations driven by stress concentration after wellbore evacuation. Drained solutions take into account stress perturbations due to pore pressure variation. The drained and undrained solutions are combined with a shear failure criterion, such as the Drucker-Prager criterion, to determine a critical collapse mud weight. Other types of failure criteria, such as the Mohr-Coulomb failure criterion, may also be used. Additionally, the drained and undrained solutions may be used in combination with tensile strength properties of the formation rock to determine a crucial fracturing mud weight. As a result, the drained and undrained solutions may be used to determine a mud weight window that accounts for both a critical collapse mud weight and a critical fracturing mud weight so that a mud weight may be selected over the course of a drilling operation that avoids a critical collapse mud weight in which a mud weight leads to an underpressure condition, resulting in collapse of the formation rock within the wellbore, as well as a critical fracturing mud weight in which a mud weight leads to an overpressure condition, causing the formation to hydraulically fracture. Elastic and inelastic solutions conventionally used do not take into account stress and pore pressure perturbations during wellbore drilling. These solutions produce a mud weight that may result in an underpressure condition, causing collapse of the formation rock, or an overpressure condition, resulting in fracturing of the formation rock.

The drained and undrained solutions may be categorized as poroelastic or dual-poroelastic. Poroelastic drained and undrained solutions are applicable to intact (or non-naturally fractured) rock, and the dual-poroelastic drained and undrained solutions are applicable to naturally-fractured rock. Dual-poroelasticity simulates naturally fractured rock as an overlapping of two porous media, where the two porous media are the rock matrix and the natural fractures present in the rock matrix. Each of the two porous media has particular permeability and mechanical properties. On the other hand, a material having single poroelasticity corresponds to rock formed from a porous medium with a single permeability. The poroelastic drained solution is applicable to intact (that is, non-fractured), conventional rock formations, and the poroelastic undrained solution is applicable intact, unconventional rock formations. The dual-poroelastic drained solution is applicable to naturally-fractured, conventional rock formations, and the dual-poroelastic undrained solution is applicable to naturally-fractured, unconventional rock formations.

Determining a mud weight window that reflects changes over time during a drilling operation involves determining strains and pore pressures of formation rock. The determined strains and pore pressure are used to determined stresses in the formation rock around the wellbore. The determined stresses are compared to stresses associated with particular failure criteria. The failure criteria and determined stresses are used to produce a time-dependent mud weight window. Determination of the strains and pore pressures includes the use of a set of governing equations that are interrelated, as described later.

The governing equations include constitutive equations. The constitutive equations for a homogeneous and isotropic dual-poroelastic porous medium (which includes naturally fractured rock formations) are used in defining the drained and undrained solutions. A first equation, Equation 1, is a stress tensor of stress within a reservoir rock, and is as follows:

$$\sigma_{ij} = \left(\overline{K} - \frac{2}{3}\overline{G}\right)\varepsilon\delta_{ij} + 2\overline{G}\varepsilon_{ij} + (\overline{\alpha}^{I} p^{I} + \overline{\alpha}^{II} p^{II})\delta_{ij} \qquad \text{Equation 1}$$

where $\overline{K}$ is the overall bulk modulus of the formation rock; $\overline{G}$ is the overall shear modulus of the formation rock; $\varepsilon$ represents the volumetric strain of the formation rock; $\delta_{ij}$ is the Kronecker delta, where $\delta_{ij}=0$ if $i \neq j$; i and j are axis designations; I and II designate the porous rock matrix of the formation rock and the porous rock fractures of the formation rock, respectively; $\overline{\alpha^{I}}$ and $\overline{\alpha^{II}}$ are the effective pore pressure coefficients for the porous rock matrix and the porous rock fractures, respectively; p is pore pressure; and $p^I$ and $p^{II}$ are the pore pressures in the porous rock matrix and the porous rock fractures, respectively.

Equations 2 and 3 represent the variation of the total fluid content of the porous rock matrix and the porous rock fractures of the formation rock, respectively.

$$\zeta^I = \bar{\alpha}^I \varepsilon + \frac{p^I}{\overline{M}^I} + \frac{p^{II}}{\overline{M}^{I,II}} \quad \text{Equation 2}$$

$$\zeta^{II} = \bar{\alpha}^{II} \varepsilon + \frac{p^I}{\overline{M}^{I,II}} + \frac{p^{II}}{\overline{M}^{II}} \quad \text{Equation 3}$$

where $\overline{\alpha^I}$ and $\overline{\alpha^{II}}$ are the effective pore pressure coefficients for the porous rock matrix and the porous rock fractures, respectively; c represents volumetric strain of the formation rock material; $\overline{M}^I$, $\overline{M}^{II}$, $\overline{M}^{I,II}$ are the effective coupled Biot's moduli for the porous rock matrix, the porous rock fractures, and for the combination of the porous rock matrix and the porous rock fractures, respectively; and $p^I$ and $p^{II}$ are the pore porosity for the porous rock matrix and the porous rock fractures, respectively. The Biot's modulus for a porous rock matrix is a material property, and values for the Biot's modulus may be determined by experimentally. The Biot's modulus for porous fractures may be selected using analytical solutions based on well testing data.

Applicable flow equations describing the dual-permeability nature of fractured formations include Darcy's law for fluid flow in both the matrix medium and the fractures of the formation rock. Based on the premise that flow in each of the porous rock matrix and the porous rock fractures are independent of each other, the Darcy's law equations are as follows:

$$q_i^I = -\frac{k^I}{\mu}\frac{\partial p^I}{\partial x_i} \quad \text{Equation 4}$$

$$q_i^{II} = -\frac{k^{II}}{\mu}\frac{\partial p^{II}}{\partial x_i} \quad \text{Equation 5}$$

where I and II designate the porous rock matrix of the formation rock and the porous rock fractures of the formation rock, respectively; $p^I$ and $p^{II}$ are the pore pressure for the porous rock matrix and the porous rock fractures, respectively; i is an axis designation; $k^I$ and $k^{II}$ are the permeabilities of the porous rock matrix and the porous rock fractures, respectively; and μ is the fluid viscosity. Values for $k^I$ and $k^{II}$ may be determined experimentally using, for example, pressure transmission testing or core flooding testing.

Other governing equations include a strain-displacement equation, an equilibrium equation, and mass balance equations. The strain-displacement equation is as follows:

$$\varepsilon_{ij} = \frac{1}{2}\left(\frac{\partial u_i}{\partial x_j} + \frac{\partial u_j}{\partial x_i}\right) \quad \text{Equation 6}$$

where i and j are axis designations; ε represents volumetric strain; $\varepsilon_{ij}$ is the strain tensor; and $u_i$ and $u_j$ represent displacement in the $x_i$ and $x_j$ directions, respectively. The strain equilibrium equation is a follows:

$$\frac{\partial \sigma_{ij}}{\partial x_j} = 0 \quad \text{Equation 7}$$

where i and j are axis designations and $\sigma_1$ is a stress tensor. The mass balance equations are as follows:

$$\frac{\partial \zeta^I}{\partial t} = -v^I \frac{\partial q_i^I}{\partial x_i} - \Gamma \quad \text{Equation 8}$$

$$\frac{\partial \zeta^{II}}{\partial t} = -v^{II} \frac{\partial q_i^{II}}{\partial x_i} - \Gamma \quad \text{Equation 9}$$

where I and II designate the porous rock matrix of the formation rock and the porous rock fractures of the formation rock, respectively; i is an axis designation; $v^I$ and $v^{II}$ are the bulk volume fractions; and Γ is the total fluid volumetric flux. Γ is defined by the following equation:

$$\Gamma = \lambda(p^{II} - p^I) \quad \text{Equation 10}$$

where $p^I$ and $p^{II}$ are the pore porosity for the porous rock matrix and the porous rock fractures, respectively, and λ is the interflow characteristic having units of $(Pa^{-1} \cdot s^{-1})$, where Pa is pascals and s is seconds.

Equations 1 through 10 are coupled and combine as follows to define the drained and undrained solutions for pore pressure and effective stress and, ultimately, a mud weight window. FIG. 1 is a flowchart illustrating a procedure 100 by which the Equations 1-10 are combined to produce equations for effective stresses used to calculate a mud weight window. At 102, Equations 4 and 5, which represents Darcy's law, are substituted into Equations 8 and 9, respectively, in order to eliminate the fluid fluxes in Equations 8 and 9. This operation creates updated Equations 8 and 9. At 104, Equations 2 and 3 are substituted into the updated Equations 8 and 9 in order to obtain diffusion equations in which strain and pore pressure are coupled. At 106, Equation 1 is combined with Equations 6 and 7 to obtain compatibility equations with strain and pore pressure coupled. At 108, the compatibility equations are combined with the diffusion equations, and the resulting equations are solved to produce solutions for strain and pore pressure. At 110, the solutions for strain and pore pressure are substituted into Equation 1 to obtain the solutions for effective stresses.

Figure 2B:
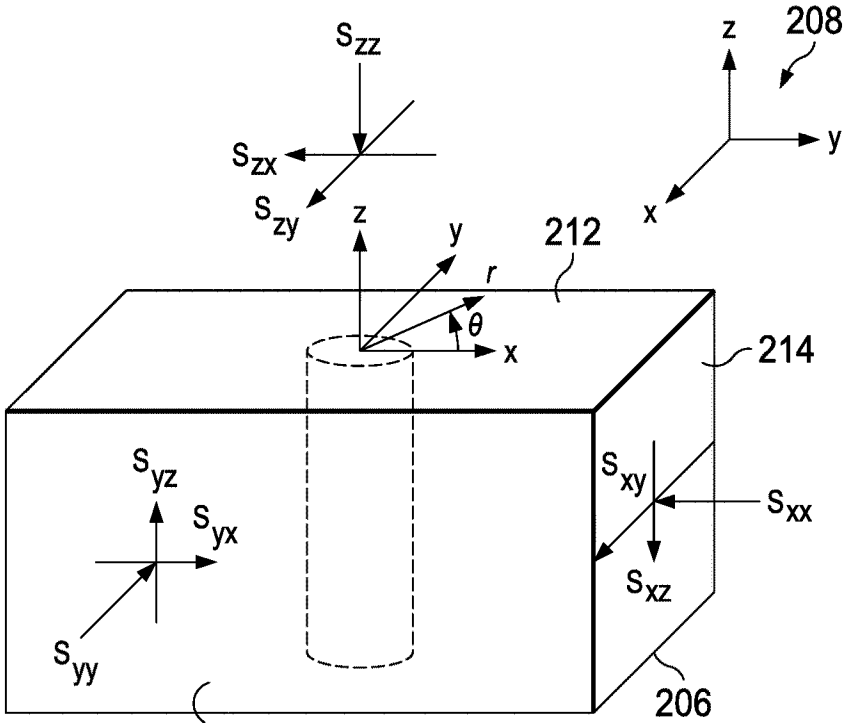
FIG. 2B is a free-body diagram showing a portion of the formation rock of FIG. 2A according to a different coordinate system, according to some implementations of the present disclosure.
Figure 2A:
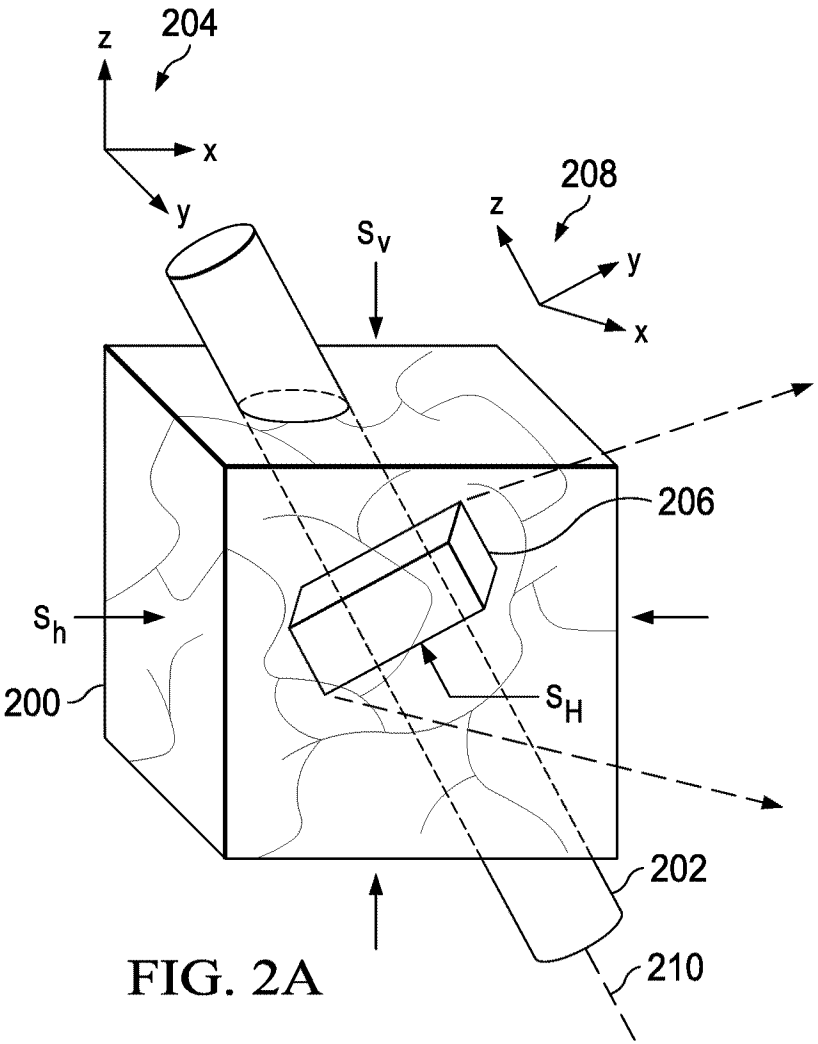
FIG. 2A is a free-body diagram showing a portion of formation rock, according to some implementations of the present disclosure.

FIG. 2A is a free-body diagram showing a portion 200 of formation rock with an inclined wellbore 202 extending through the portion 200 of a rock formation. Stresses $S_V$, $S_H$, and $S_h$ are stresses applied to the portion 200 of the rock formation according to a first Cartesian coordinate system 204. $S_V$ is a stress applied along the Z-axis, $S_H$ is a stress applied along the Y-axis, and $S_h$ is a stress applied along the X-axis. Another portion 206 of the formation rock is shown. The portion 206 of the rock formation is oriented in relation to the wellbore 202 according to a second Cartesian coordinate system 208 such that a z-axis of second Cartesian coordinate system 208 is parallel with a longitudinal axis 210 of the wellbore 202.

FIG. 2B is a free-body diagram showing the portion 206 of the formation rock with different stress states applied on different perpendicular planes. The states of stress associated with each of the planes are components of the original stress state converted to the second Cartesian coordinate system 208. On a first plane 212, which corresponds to the xy plane according to the Cartesian coordinate system 208, the state of stress is $S_{zz}$, $S_{zx}$, and $S_{zy}$. On the second plane 214, which corresponds to the xz plane according to the Cartesian coordinate system 208, the state of stress is $S_{xx}$, $S_{xy}$, and $S_{xz}$. A third plane 216, which corresponds to the yz plane according to the Cartesian coordinate system 208, has a state of stress of $S_{yy}$, $S_{yz}$, and $S_{yx}$. Also shown on the first plane 212 is a radius, r, extending perpendicularly from the z-axis and an angular designation, θ. The radius, r, is used to designate radial stresses, and θ is used to designate an angle. The angle measurement, θ, lies in the xy plane and identifies a location around a wall of the wellbore 202. The angle measurement, θ, is used to designate tangential stresses at different locations around the wall of the wellbore 202 and has a value between 0° to 360°.

The stress and pore pressure equations associated with shear failure and tensile failure obtained via the procedure of FIG. 1, described earlier, are adapted to drained and undrained solutions in the context of a Cartesian coordinate system similar to the second Cartesian coordinate system 208 shown in FIG. 2. Further, for each of the drained and undrained solutions, pore pressure and stress equations are generated in the context of a poroelastic solution and a dual-poroelastic solution. As a result, poroelastic and dual-poroelastic equations, in both the drained and undrained contexts, are obtained. For undrained solutions, the following boundary conditions are applied to the obtained pore pressure an stress equations from the method of FIG. 1 are: $\sigma_{rr}(r=R)=p_w$, $\sigma_{rr}(r=\infty)=\sigma_{rr0}$, where r is a selected radial distance; R is the radius of a wellbore; and $p_w$ is the wellbore pressure. The boundary conditions for the drained solutions are as follows:

$$\sigma_{rr}(r=R)=p_w,\ \sigma_{rr}(r=\infty)=\frac{1-2v}{2(1-V)}\alpha(p_w-p_0)+\sigma_{rr0},$$

where $\sigma_{rr0}$ is the in-situ radial stress; ν is the Poisson's ratio; a is the Biot's coefficient; $p_0$ is the in-situ pore pressure; and $p_w$ is the wellbore pressure. The boundary conditions applied to the undrained solutions because the far-field stresses remain unchanged. Thus, the far-field stresses and stresses are set equal to in-situ values. The applied boundary conditions reflect this underlying basis. For the drained conditions, the far-field stresses are made to change because the pore pressure changes from an initial pore pressure, $p_0$, to wellbore pressure, $p_w$, as a result of fluid diffusion.

Table 1 shows the equations for the poroelastic and dual-poroelastic solutions obtained from the governing equations using the process described above with respect to FIG. 1. Equations for the elastic solution conventionally used are also listed for comparison.

TABLE 1

Component stresses associated with the poroelastic and dual-poroelastic undrained solutions compared to the component stresses of the conventional elastic solution.

| Elastic | Poroelastic Undrained Solution | Dual-Poroelastic Undrained Solution |
|---|---|---|
| $\sigma_{rr}^{ela}$ | $\sigma_{rr}^{sing,\ ud}=\sigma_{rr}^{ela}$ | $\sigma_{rr}^{dual,\ ud}=\sigma_{rr}^{ela}$ |
| $\sigma_{\theta\theta}^{ela}$ | $\sigma_{\theta\theta}^{sing,\ ud}=\sigma_{\theta\theta}^{ela}$ | $\sigma_{\theta\theta}^{dual,\ ud}=\sigma_{\theta\theta}^{ela}$ |

TABLE 1-continued

Component stresses associated with the poroelastic and dual-poroelastic undrained solutions compared to the component stresses of the conventional elastic solution.

| Elastic | Poroelastic Undrained Solution | Dual-Poroelastic Undrained Solution |
|---|---|---|
| $\sigma_{zz}^{ela}$ | $\sigma_{zz}^{sing,\ ud}=\sigma_{zz}^{ela}$ | $\sigma_{zz}^{dual,\ ud}=\sigma_{zz}^{ela}+(1-2\bar{v})[\bar{\alpha}_1(p_1^{dual,\ ud}-p_0)+2\bar{\alpha}_2(p_2^{dual,\ ud}-p_0)]$ |
| $\sigma_{r\theta}^{ela}$ | $\sigma_{r\theta}^{sing,\ ud}=\sigma_{r\theta}^{ela}$ | $\sigma_{r\theta}^{dual,\ ud}=\sigma_{r\theta}^{ela}$ |
| $\sigma_{\theta z}^{ela}$ | $\sigma_{\theta z}^{sing,\ ud}=\sigma_{\theta z}^{ela}$ | $\sigma_{\theta z}^{dual,\ ud}=\sigma_{\theta z}^{ela}$ |
| $\sigma_{rz}^{ela}$ | $\sigma_{rz}^{sing,\ ud}=\sigma_{rz}^{ela}$ | $\sigma_{rz}^{dual,\ ud}=\sigma_{rz}^{ela}$ |

In Table 1, a identifies stress. The meanings of the various subscripts presented in Table 1 are as follows: "rr" is used to identify radial stresses; "θθ" is used to identify tangential stresses; "zz" is used to identify axial stresses; "rθ," "θz," and "rz" are used to identify shear stresses present on the rθ, θz, and rz planes, respectively. The meanings of the various superscripts presented in Table 1 are as follows: "ela" represents "elastic"; "sing" represents "single porosity"; and "ud" represents "undrained." Thus, "ela" identifies the conventional elastic solution, and "sing, ud" identifies the single porosity poroelastic undrained solution.

Also with respect to the equations presented in Table 1, $\bar{\alpha}_1$ and $\bar{\alpha}_2$ represents the Biot's number of the formation rock matrix and formation rock fractures, respectively; $\bar{v}$ is Poisson's ratio of the formation rock; and $p_0$ is the initial pore pressure; $p_1$ is the pore pressure of the formation rock matrix; and $p_2$ is the pore pressure of the formation rock fractures.

The relevant equations for the conventional elastic stress solutions are as follows:

$$\sigma_{rr}^{ela}=\frac{S_x+S_y}{2}\left(1-\frac{R^2}{r^2}\right)+\frac{S_x-S_y}{2}\left(1+\frac{3R^4}{r^4}-\frac{4R^2}{r^2}\right)\cos 2\theta+S_{xy}\left(1+\frac{3R^4}{r^4}-\frac{4R^2}{r^2}\right)\sin 2\theta+p_w\frac{R^2}{r^2} \quad \text{Equation 11}$$

$$\sigma_{\theta\theta}^{ela}=\frac{S_x+S_y}{2}\left(1+\frac{R^2}{r^2}\right)-\frac{S_x-S_y}{2}\left(1+\frac{3R^4}{r^4}\right)\cos 2\theta-S_{xy}\left(1+\frac{3R^4}{r^4}\right)\sin 2\theta-p_w\frac{R^2}{r^2} \quad \text{Equation 12}$$

$$\sigma_{zz}^{ela}=S_z-v\left[2(S_x-S_y)\frac{R^2}{r^2}\cos 2\theta+4S_{xy}\frac{R^2}{r^2}\sin 2\theta\right] \quad \text{Equation 13}$$

$$\sigma_{r\theta}^{ela}=\frac{-S_x+S_y}{2}\left(1-\frac{3R^4}{r^4}+\frac{2R^2}{r^2}\right)\sin 2\theta+S_{xy}\left(1-\frac{3R^4}{r^4}+\frac{2R^2}{r^2}\right)\sin 2\theta \quad \text{Equation 14}$$

$$\sigma_{\theta z}^{ela}=\frac{-S_x+S_y}{2}\left(1-\frac{3R^4}{r^4}+\frac{2R^2}{r^2}\right)\sin 2\theta+S_{xy}\left(1-\frac{3R^4}{r^4}+\frac{2R^2}{r^2}\right)\cos 2\theta \quad \text{Equation 15}$$

$$\sigma_{rz}^{ela}=(S_{xz}\cos\theta+S_{yz}\sin\theta)\left(1-\frac{R^2}{r^2}\right) \quad \text{Equation 16}$$

For Equations 11 through 16, $S_x$, $S_y$, $S_{xy}$, $S_{xz}$, and $S_{yz}$ are the in-situ stresses expressed in the wellbore coordinates; ν is the Poisson's ratio; $p_w$ is the wellbore pressure; R is the radius of the wellbore; and r is a selected radial distance

TABLE 2

| Poroelastic and dual-poroelastic undrained pore pressure response solutions. |
|---|
| Poroelastic Undrained Solution |
| $p^{sing,ud} = p_0 - \frac{4B(1+v)}{3-\alpha B(1-2v)}\frac{R^2}{r^2}\sigma_d \cos 2(\theta-\theta_r)$ |
| Dual-Poroelastic Undrained Solutions |
| $p_1^{dual,ud} = p_0 - \frac{4B_1(1-2\overline{\alpha}_2B_2)(1+\overline{v})}{3-\overline{\alpha}_2B_2(1-2\overline{v})-\overline{\alpha}_1B_1[1-2\overline{v}+8\overline{\alpha}_2B_2(1+\overline{v})]}\frac{R^2}{r^2}\sigma_d \cos(\theta-\theta_r)$ |
| $p_2^{dual,ud} = p_0 - \frac{4B_2(1-2\overline{\alpha}_1B_1)(1+\overline{v})}{3-\overline{\alpha}_2B_2(1-2\overline{v})-\overline{\alpha}_1B_1[1-2\overline{v}+8\overline{\alpha}_2B_2(1+\overline{v})]}\frac{R^2}{r^2}\sigma_d \cos(\theta-\theta_r)$ |

In Table 2, $p_1$ and $p_2$ represent pore pressure in rock matrix and fractures, respectively. A weighted sum $\overline{\alpha}_1p_1+\overline{\alpha}_2p_2$ usually used to calculate the effective stresses in the overall rock, which is then used in the calculation of the mud weight window. The meanings of the various superscripts presented in Table 2 are as follows: "sing" represents"single porosity"; "dual" represents dual-porosity; and "ud" represents undrained. Thus, "sing, ud" identifies the single porosity poroelastic undrained solution, and "dual, ud" identifies the dual-porosity poroelastic undrained solution. The meanings of the various subscripts presented in Table 1 are as follows: "rr" is used to identify radial stresses; "θθ" is used to identify tangential stresses; "zz" is used to identify axial stresses; "rθ," "θz," and "rz" are used to identify shear stresses present on the rθ, θz, and rz planes, respectively.

Also with respect to the equations presented in Table 2, $\sigma_d$ is the is the deviatoric stress; θ is an angular measurement about a vertical axis of the wellbore used to designate a location around the wall of a wellbore; $\theta_r$ is the direction of the maximum in-plane principal stress; $\overline{\alpha}_1$ and $\overline{\alpha}_2$ represent the weights in the weighted sum $\overline{\alpha}_1p_1+\overline{\alpha}_2p_2$ to calculate the effective stresses of the overall rock; u is Poisson's ratio of the formation rock; $p_1$, and $p_2$ are pore pressures for rock matrix and fractures; B, $B_1$, and $B_2$ are the Skempton's coefficients for an intact or non-fractured reservoir rock, the porous rock matrix of a formation rock, and porous rock fractures of a formation rock; R is the radius of the wellbore; and r is a selected radial distance.

For a drained condition, the pore pressure in the rock matrix and fractures is equal to the wellbore pressure.

TABLE 3

| Component stresses associated with the poroelastic and dual-poroelastic drained solutions compared to the component stresses of the conventional elastic solution. | | |
|---|---|---|
| Elastic | Poroelastic Drained Solution | Dual-Poroelastic Drained Solution |
| $\sigma_{rr}^{ela}$ | $\sigma_{rr}^{sing,dr} = \frac{1-2v}{2(1-v)}\alpha(p_w-p_0)\left(1-\frac{R^2}{r^2}\right)+\sigma_{rr}^{ela}$ | $\sigma_{rr}^{dual,dr} = \sigma_{rr}^{sing,dr}$ |
| $\sigma_{\theta\theta}^{ela}$ | $\sigma_{\theta\theta}^{sing,dr} = \frac{1-2v}{2(1-v)}\alpha(p_w-p_0)\left(1-\frac{R^2}{r^2}\right)+\sigma_{\theta\theta}^{ela}$ | $\sigma_{\theta\theta}^{dual,dr} = \sigma_{\theta\theta}^{sing,dr}$ |
| $\sigma_{zz}^{ela}$ | $\sigma_{zz}^{sing,dr} = \frac{1-2v}{1-v}\alpha(p_w-p_0)+\sigma_{zz}^{ela}$ | $\sigma_{zz}^{dual,dr} = \sigma_{dr}^{sing,dr}$ |
| $\sigma_{r\theta}^{ela}$ | $\sigma_{r\theta}^{sing,dr} = \sigma_{r\theta}^{ela}$ | $\sigma_{r\theta}^{dual,ud} = \sigma_{r\theta}^{ela}$ |

TABLE 3-continued

| Component stresses associated with the poroelastic and dual-poroelastic drained solutions compared to the component stresses of the conventional elastic solution. | | |
|---|---|---|
| Elastic | Poroelastic Drained Solution | Dual-Poroelastic Drained Solution |
| $\sigma_{\theta z}^{ela}$ | $\sigma_{\theta z}^{sing,dr} = \sigma_{\theta z}^{ela}$ | $\sigma_{\theta z}^{dual,ud} = \sigma_{\theta z}^{ela}$ |
| $\sigma_{rz}^{ela}$ | $\sigma_{rz}^{sing,dr} = \sigma_{rz}^{ela}$ | $\sigma_{rz}^{dual,ud} = \sigma_{rz}^{ela}$ |

In Table 3, σ identifies stress. The meanings of the various subscripts presented in Table 3 are identical to those described earlier with respect to Table 1 are as follows: "rr" is used to identify radial stresses; "θθ" is used to identify tangential stresses; "zz" is used to identify axial stresses; "rθ," "θz," and "rz" are used to identify shear stresses present on the rθ, θz, and rz planes, respectively. The meanings of the various superscripts presented in Table 1 are as follows: "ela" represents "elastic"; "sing" represents "single porosity"; and "dr" represents "drained." Thus, "ela" identifies the conventional elastic solution; "sing, dr" identifies the single porosity poroelastic drained solution; and "dual, dr" identifies the dual-porosity poroelastic drained solution.

Also with respect to the equations presented in Table 3, α represents the effective pore pressure of the formation rock; ν is Poisson's ratio of the formation rock; $p_0$ and $p_w$ are the initial pore pressure and the wellbore pore pressure; R is the radius of the wellbore; and r is a selected radial distance.

With the solutions presented in Table 1, 2, and 3, the stresses and pore pressures for a particular formation rock type are determinable. Time-dependent solutions for stresses and pore pressures associated with a wellbore drilling operation in a particular formation rock type are determined related to the equations provided in Tables 1, 2, and 3 by $$\text{Drained Solutions} = \lim_{t\to\infty}(\text{Time}-\text{dependent solutions}) \quad \text{Equation 17}$$

$$\text{Undrained Solutions} = \lim_{t\to 0^+}(\text{Time}-\text{dependent solutions}) \quad \text{Equation 18}$$

With these time-dependent stress and pore pressure solutions, a time-dependent solution for a mud weight window is determined by applying the Drucker-Prager criterion to the time-dependent stress and pore pressure solutions. After the time-dependent solutions are combined with the Drucker-Prager criterion to define the failure potentials, the stresses and pore pressure presented in Tables 1-3 are combined with the failure criteria to calculate the mud weight window as is explained later in more detail with reference to FIGS. 7 and 8.

The Drucker-Prager criterion is expressed as follows:

$$\sqrt{J_2}=3A_0S_p+D_0 \quad \text{Equation 19}$$

where $A_0$ and $D_0$ are material-strength parameters defined as $$A_0 = \frac{6c\cos\phi}{\sqrt{3}\,(3-\sin\phi)} \text{ and } D_0 = \frac{2\sin\phi}{\sqrt{3}\,(3-\sin\phi)}$$

where $A_0$ and $D_0$ are cohesion and friction angle, respectively; $\sqrt{J_2}$ is the mean shear stress defined by:

$$J_2=1/6[(\sigma_{rr}-\sigma_{\theta\theta})^2+(\sigma_{\theta\theta}-\sigma_{zz})^2+(\sigma_{zz}\sigma_{rr})^2]+\sigma_{r\theta}^2+\sigma_{rz}^2+\sigma_{\theta z}^2 \quad \text{Equation 20}$$

and where $S_p$ is the mean effective stress defined by:

$$S_p = \frac{\sigma_{rr}+\sigma_{\theta\theta}+\sigma_{zz}}{3} - p \quad \text{Equation 21}$$

where p is the weighted average pore pressure of the rock matrix and fractures, i.e., $\overline{\alpha}_1\rho_1+\overline{\alpha}_2\rho_2$, and $\sigma_{rr}$, $\sigma_{\theta\theta}$, and $\sigma_{zz}$ are the radial, tangential, axial stresses, as defined earlier. The Drucker-Prager criterion predicts that shear failure occurs when $\sqrt{J_2}=3A_0S_p+D_0$ and that shear failure does not occur when $\sqrt{J_2}<3A_0S_p+D_0$.

An example application of the systems and methods of the present disclosure are now provided. This example involves a naturally-fractured, unconventional rock type. Table 4 contains the data for this example.

TABLE 4

Example data.

| Data Type | Value |
|---|---|
| True Vertical Depth, TVD (in meters (m)) | 1737 |
| Overburden Stress Gradient, dSV (in kilopascals per meter (kPa/m)) | 24.88 |
| Maximum Horizontal Stress Gradient, dSH (kPa/m) | 23.07 |
| Minimum Horizontal Stress Gradient, dSh (kPa/m) | 16.06 |
| Pore Pressure Gradient, dP (kPa/m) | 10.41 |
| Wellbore Inclination Angle (in degrees) | 0 |
| Wellbore Azimuth (in degrees) | 0 |
| Maximum Horizontal Stress Azimuth, (in degrees) | 0 |
| Poisson's Ratio, $\upsilon$ | 0.23 |
| Cohesion, c (in megapascals (MPa)) | 4.2 |
| Internal Friction Angle, $\phi$ (in degrees) | 33 |
| Tensile Strength, (MPa) | 1.4 |
| Biot's Coefficient (for rock matrix), $\alpha 1$ | 0.7 |
| Skempton's coefficient (for rock matrix), B1 | 0.6 |
| Biot's Coefficient (for rock fractures), $\alpha 2$ | 1 |
| Skempton's coefficient (for rock fractures), B2 | 0.8 |

Figure 3:
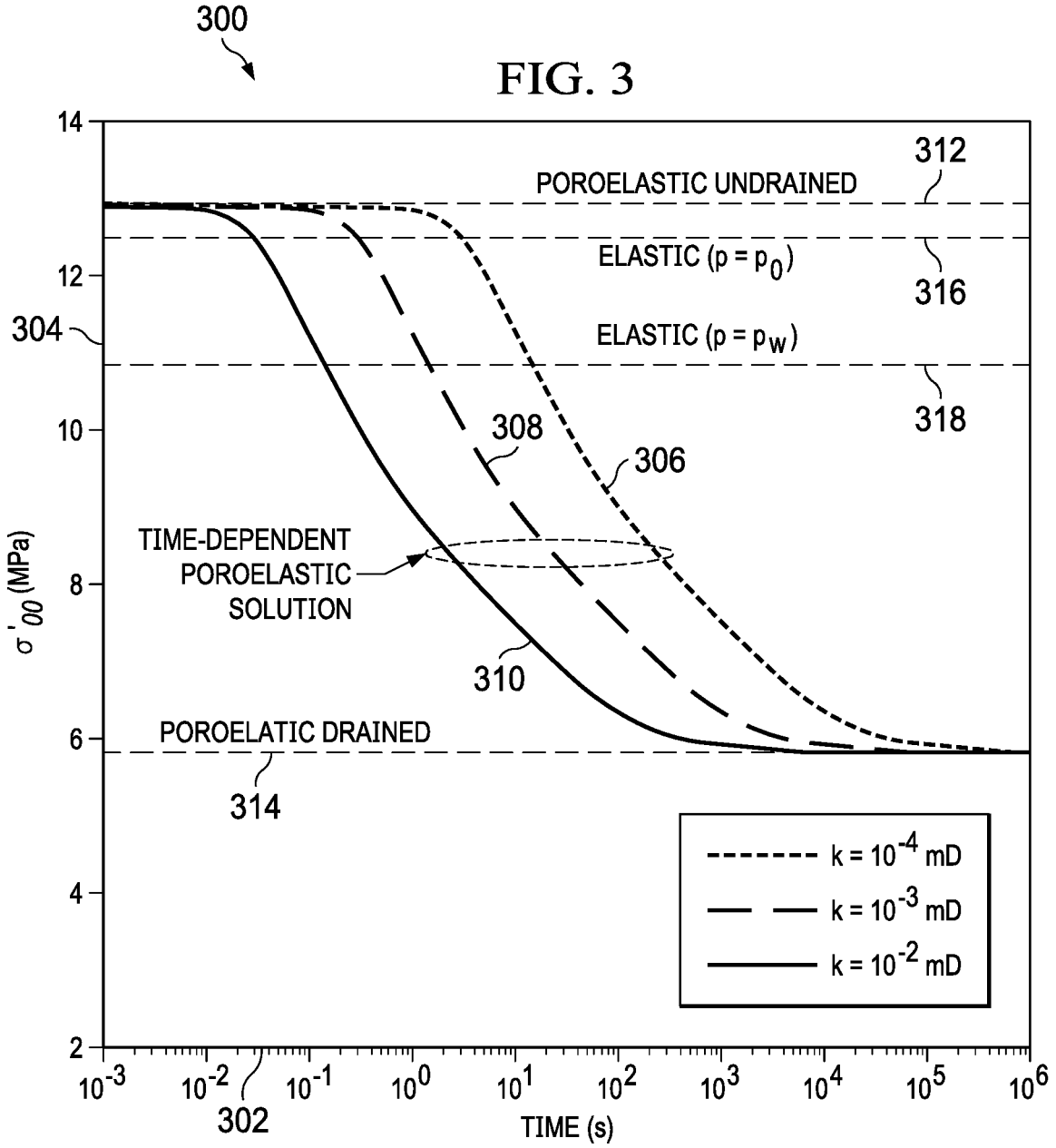
FIG. 3 is an example plot of the effective tangential stress, Gee, at a radius of r=1.5 R and at a position of 0=0° over time during the course of a drilling operation, according to some implementations of the present disclosure.

FIG. 3 is a plot 300 of the effective tangential stress, $\sigma'_{\theta\theta}$, at a radius of r=1.5 R and a position of θ=0° over time during the course of a drilling operation. Other stresses have similar trends, i.e., the drained/undrained curves are consistent with the tail/head (long-term/short-term) of the time-dependent curves, respectively. The plot 300 includes an x-axis 302 that represents time, in seconds (s), and a y-axis 304 that represents stress in MPa. The x-axis 302 has a logarithmic scale. Curves 306, 308, and 310 represent tangential stress states having a permeability value, k, of $10^{-4}$ mD, $10^{-3}$ mD, and $10^{-2}$ mD, respectively. These curves are plotted using the time-dependent solutions. Dashed line 312 represents the poroelastic undrained solution that does not account for time-dependent variation. Dashed line 312 is generated using the following equation:

$$\sigma'^{sing,ud}_{\theta\theta}=\sigma^{sing,ud}_{\theta\theta}-p^{sing,ud} \quad \text{Equation 20}$$

where $\sigma'^{sing,ud}_{\theta\theta}$ is the updated tangential stress; $\sigma^{sing,ud}_{\theta\theta}$ is the tangential stress; and $p^{sing,ud}$ is pore pressure of the rock matrix.

A dashed line 314 represents the poroelastic drained solution. Dashed line 314 is generated using the following equation:

$$\sigma'^{sing,dr}_{\theta\theta}=\sigma^{sing,dr}_{\theta\theta}-p_w \quad \text{Equation 21}$$

where $\sigma'^{sing,dr}_{\theta\theta}$ the updated tangential stress; $\sigma^{sing,dr}_{\theta\theta}$ is the tangential stress; and $p_w$ is the wellbore pressure. Dashed lines 316 and 318 represent the elastic solutions in which the pore pressure is set equal to the in-situ pore pressure and the drilling mud pressure, respectively.

The time-dependent solutions illustrated by curves 306, 308, and 310 are presented for comparison. Differences are recognizable among the solutions. The undrained solutions capture the pore pressure drop around the wellbore at θ=0°, and provide the higher effective tangential stress compared to the elastic and poroelastic drained solutions. The drained solution considers the perturbation of the in-situ stresses due to pore pressure variation. However, the elastic solutions fail to account for these time-dependent components of stress perturbation and provide different results.

Figure 4:
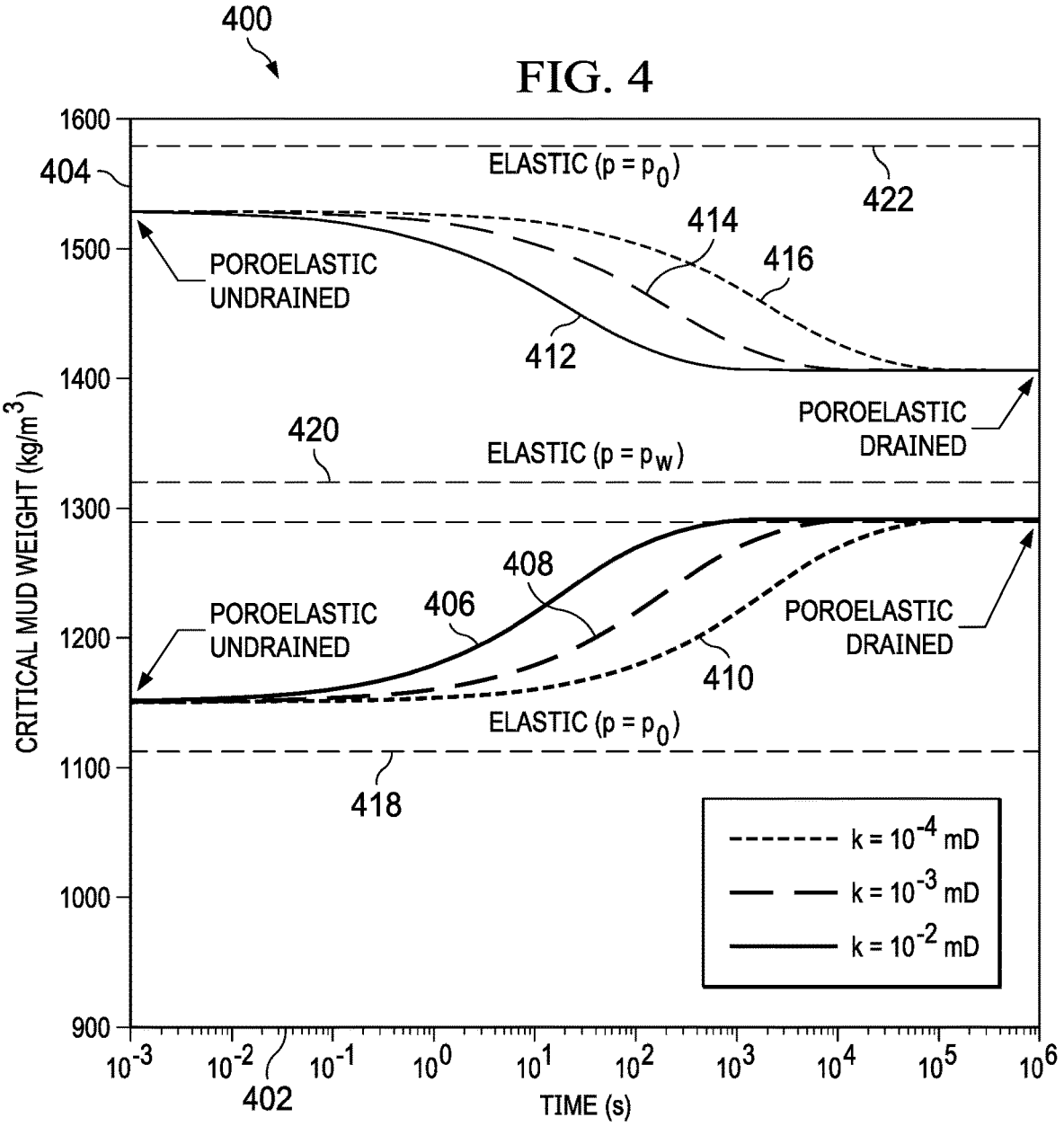
FIG. 4 is an example plot of critical mud weight over time during the course of a drilling operation, according to some implementations of the present disclosure.

FIG. 4 is a plot 400 of the critical mud weight over time during the course of a drilling operation. The plot 400 utilizes the tangential stress data from curves 306, 308, and 310 from FIG. 3. As previously explained, the stresses showed in FIG. 3 are used to define the shear and tensile failure potentials before the stresses and pore pressure presented in Tables 1-3 were combined with the failure criteria to calculate the mud weight window (as is explained later in more detail with reference to FIGS. 7 and 8) to calculate the mud weight windows shown in FIG. 4.

The plot 400 includes an x-axis 402 that represents time, in seconds, and a y-axis 404 that represents mud weight in kilograms per cubic meter (kg/m$^3$). Curves 406, 408, and 410 represent the time-dependent critical fracturing mud weight and are used to determine mud weights that would cause tensile fracturing of the formation rock during the course of the drilling operation. Curves 406, 408, and 410 correspond to permeability values, k, of $10^{-4}$ mD, $10^{-3}$ mD, and $10^{-2}$ mD, respectively.

Curves 412, 414, and 416 represent the critical collapse mud weight and are used to determine whether collapse of the wellbore wall would occur during the drilling operations and correspond to permeability values, k, of $10^{-4}$ mD, $10^{-3}$ mD, and $10^{-2}$ mD, respectively. As is shown in FIG. 4, the curves start from a poroelastic undrained solution and converge to a poroelastic drained solution. Curves 418 and 420 represent the mud weight associated with the elastic solution in which the pore pressure is constant and is equal to the in-situ pore pressure and the elastic solution in which the pore pressure is constant and is equal to the drilling mud pressure, respectively, in the context of critical fracturing mud weight. Curve 422 represents the mud weight associated with the elastic solution in which the pore pressure is constant in the context of critical collapse mud weight The Drucker-Prager failure criterion was used to generate the curves 406, 408, 410, 412, 414, and 416. However, other failure criteria may also be used. For example, in some implementations, the Mohr-Coulomb failure criterion may be used.

It is noted that the choice of the solution used to determine mud weight is influenced by factors, such as an amount of time that has elapsed since the start of a drilling operation and rock types. For example, for sandstone formation having increased permeability, the poroelastic drained solution tends to provide satisfactory results. For shale formations having reduced permeability, the poroelastic undrained solutions tend to be applicable at the initial time period at the start of a drilling operation (such as within one to five minutes following the start of a drilling operation), and the drained solutions tend to be applicable to the time period following the initial time period at the start of the drilling operation. For naturally-fractured shale formations, the dual-poroelastic undrained solution tends to provide satisfactory results for wellbore stability during the first few minutes following the start of the drilling operation. These observations are summarized in Table 5. This table provides a guideline about which solution is appropriate for each formation type.

TABLE 5

Summary of Drained and Undrained Solutions with respect to Formation Type and Fractured Nature of Formation Rock.

| Formation Type | | Intact Rock | Naturally-Fractured Rock |
|---|---|---|---|
| Conventional Formation | | Poroelastic Drained | Dual-Poroelastic Drained |
| Unconventional Formation | Initial Time Period of Drilling Operation | Poroelastic Undrained | Dual-Poroelastic Undrained |
| | Time Period following the Initial Time Period of Drilling Operation | Poroelastic Drained | Dual-Poroelastic Drained |

Figure 5:
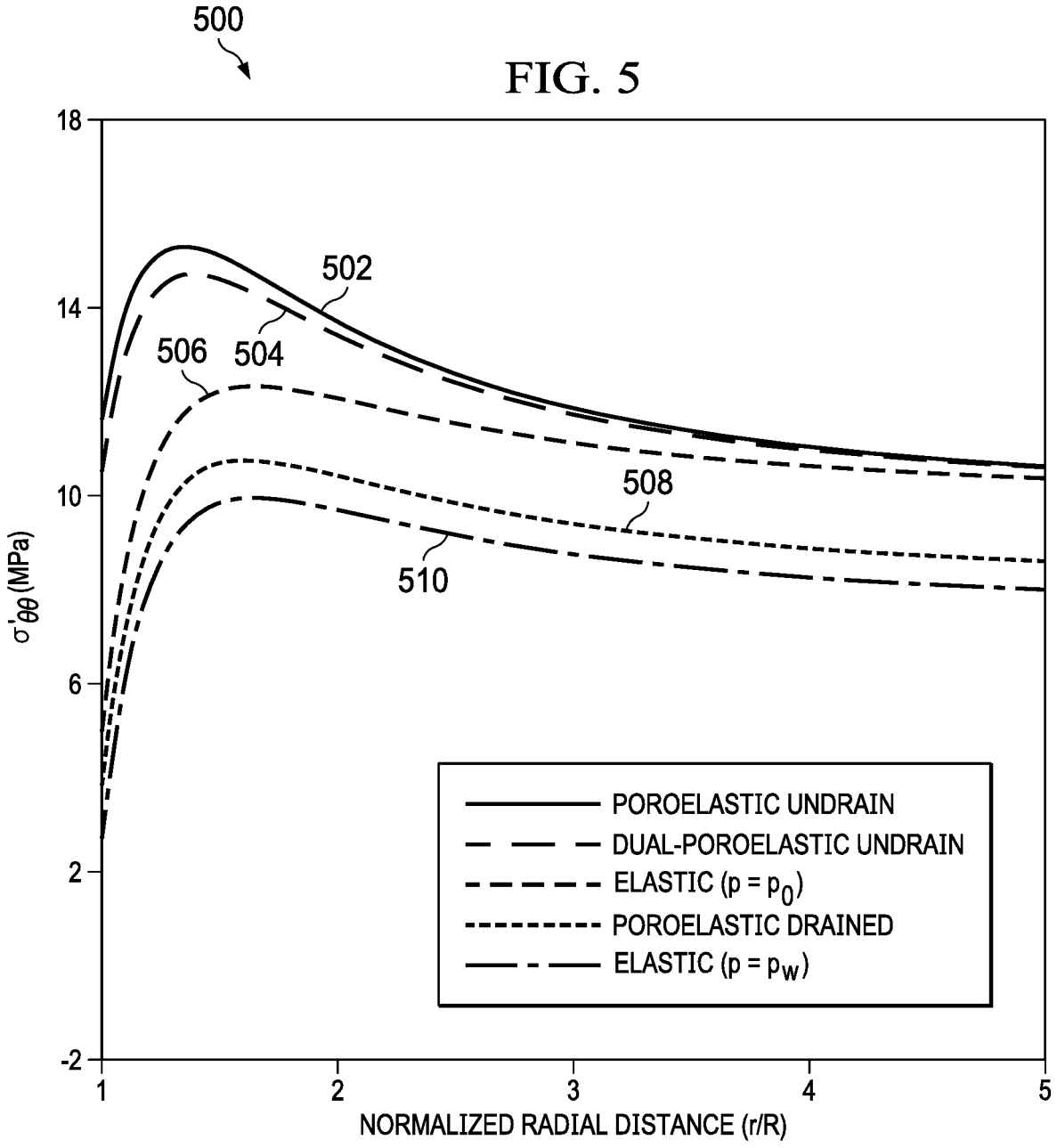
FIG. 5 is an example plot that describes tangential stress, Gee, in the wellbore wall along the radial direction at an angle, θ, of 0°, according to some implementations of the present disclosure.
Figure 6:
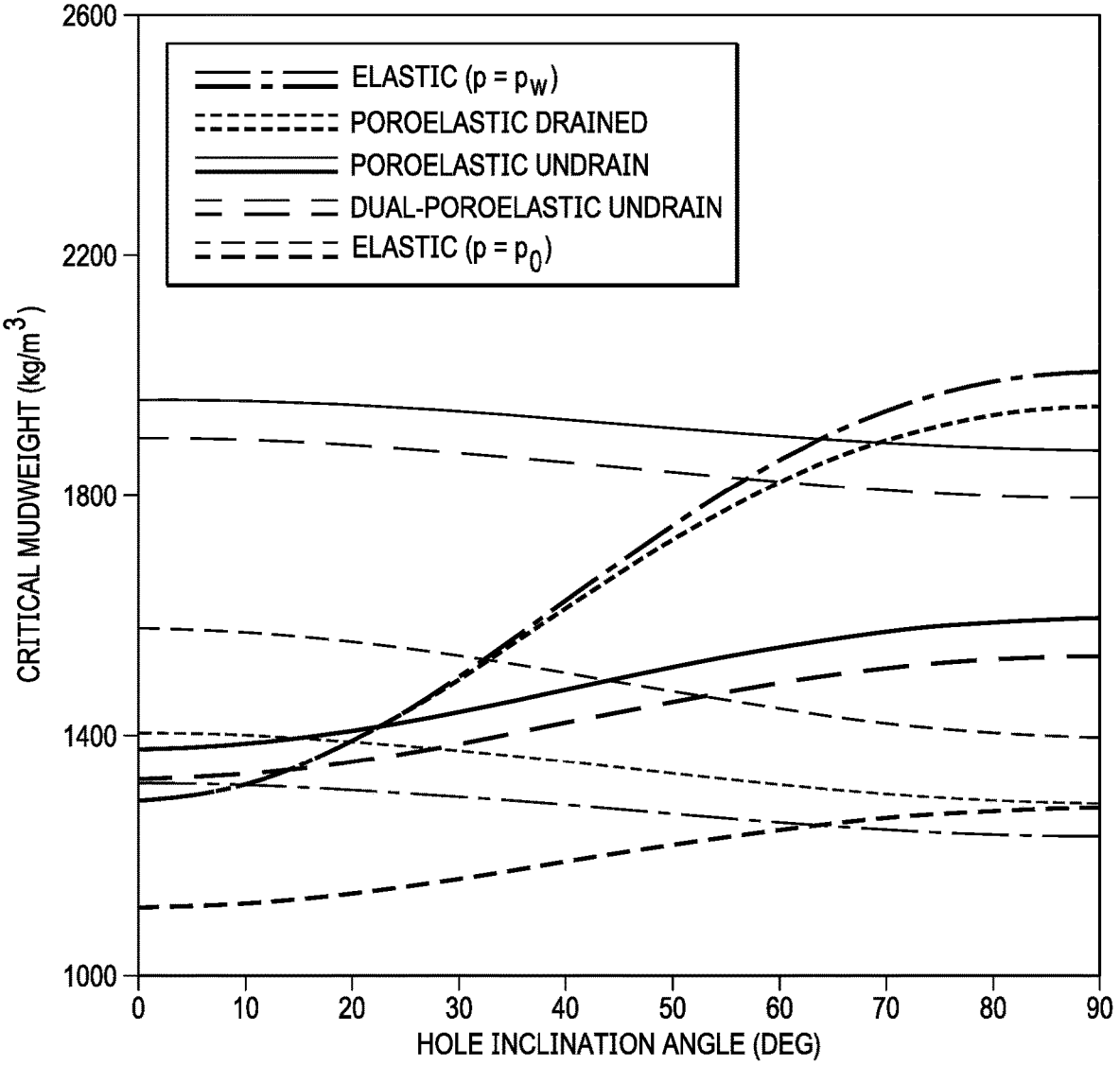
FIG. 6 is an example plot showing curves of critical mud weight versus an inclination of a wellbore for the different solutions, according to some implementations of the present disclosure.

FIG. 5 is a plot 500 that describes tangential stress, Gee, in the wellbore wall along the radial direction at an angle, θ, of 0°. The curves presented are curves 502, 504, 506, 508, and 510 represent to the poroelastic undrained solution, the dual-poroelastic undrained solution, elastic solution where the pore pressure is equal to the in-situ pressure, the poroelastic drained solution, and the elastic solution where the pore pressure is equal to the drilling mud weight, respectively. FIG. 6 illustrates a plot 600 showing curves of critical mud weight versus an inclination of a wellbore for the different solutions. FIGS. 5 and 6 show the significant differences among the solutions and emphasizes the importance of choosing the corresponding solution based on Table 5.

Figure 7:
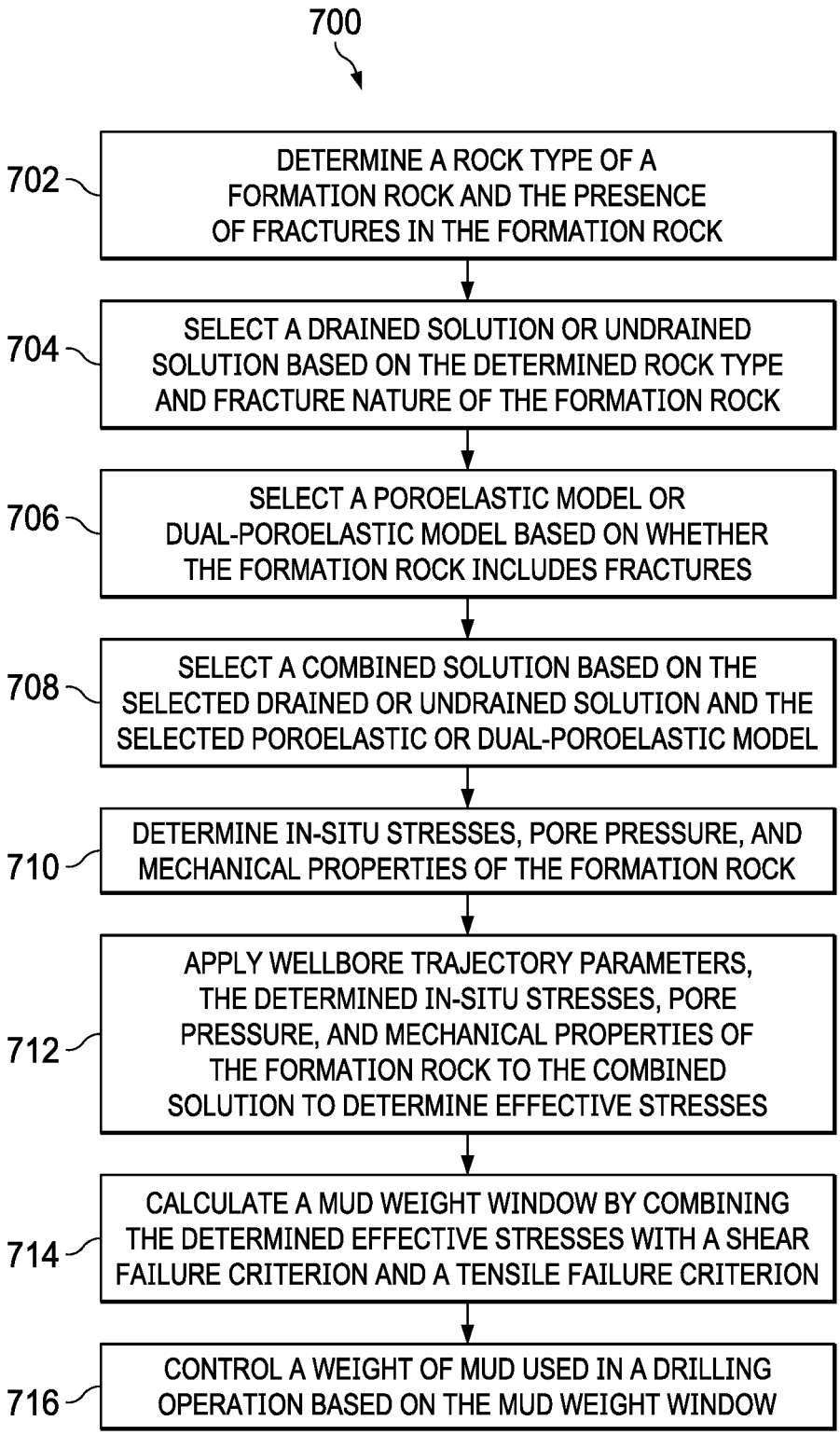
FIG. 7 a flowchart of an example method for determining a time-dependent mud weight window for a drilling operation, according to some implementations of the present disclosure.
Figure 8A:
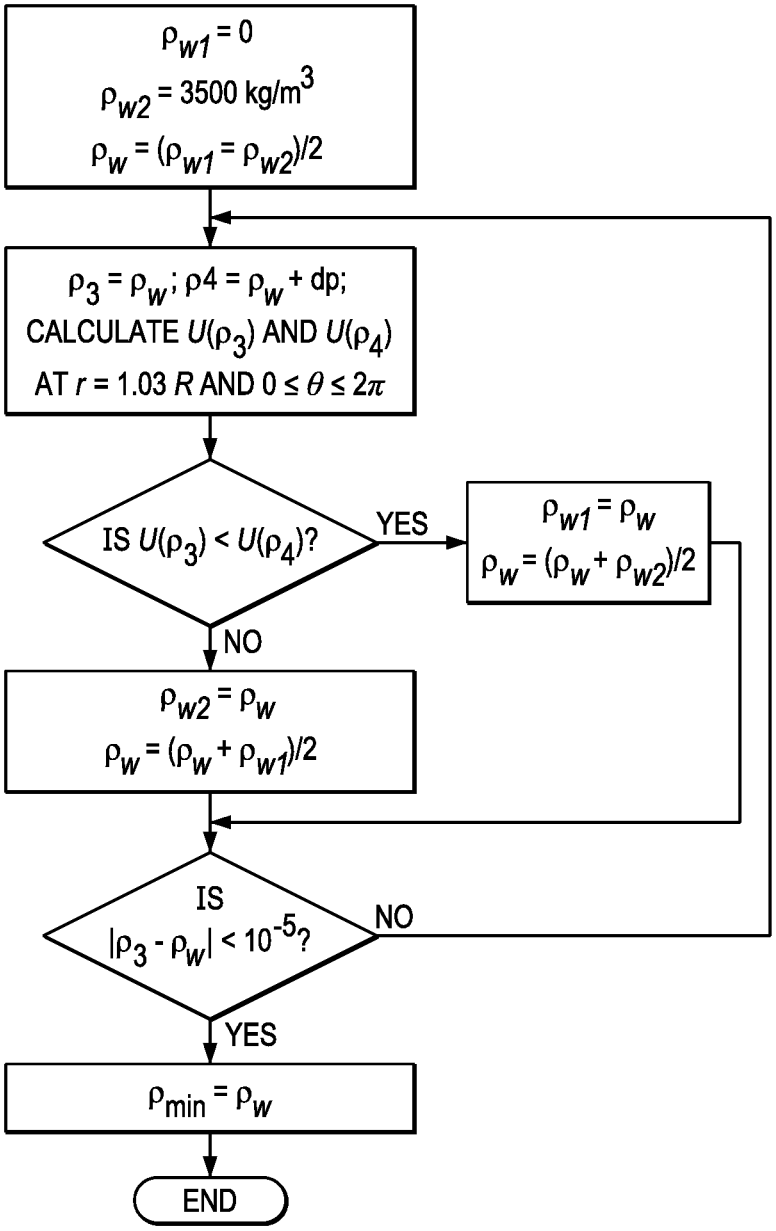
FIGS. 8A and 8B are flowcharts of an example method for determining a time-dependent mud weight window for a drilling operation, according to some implementations of the present disclosure.
Figure 8B:
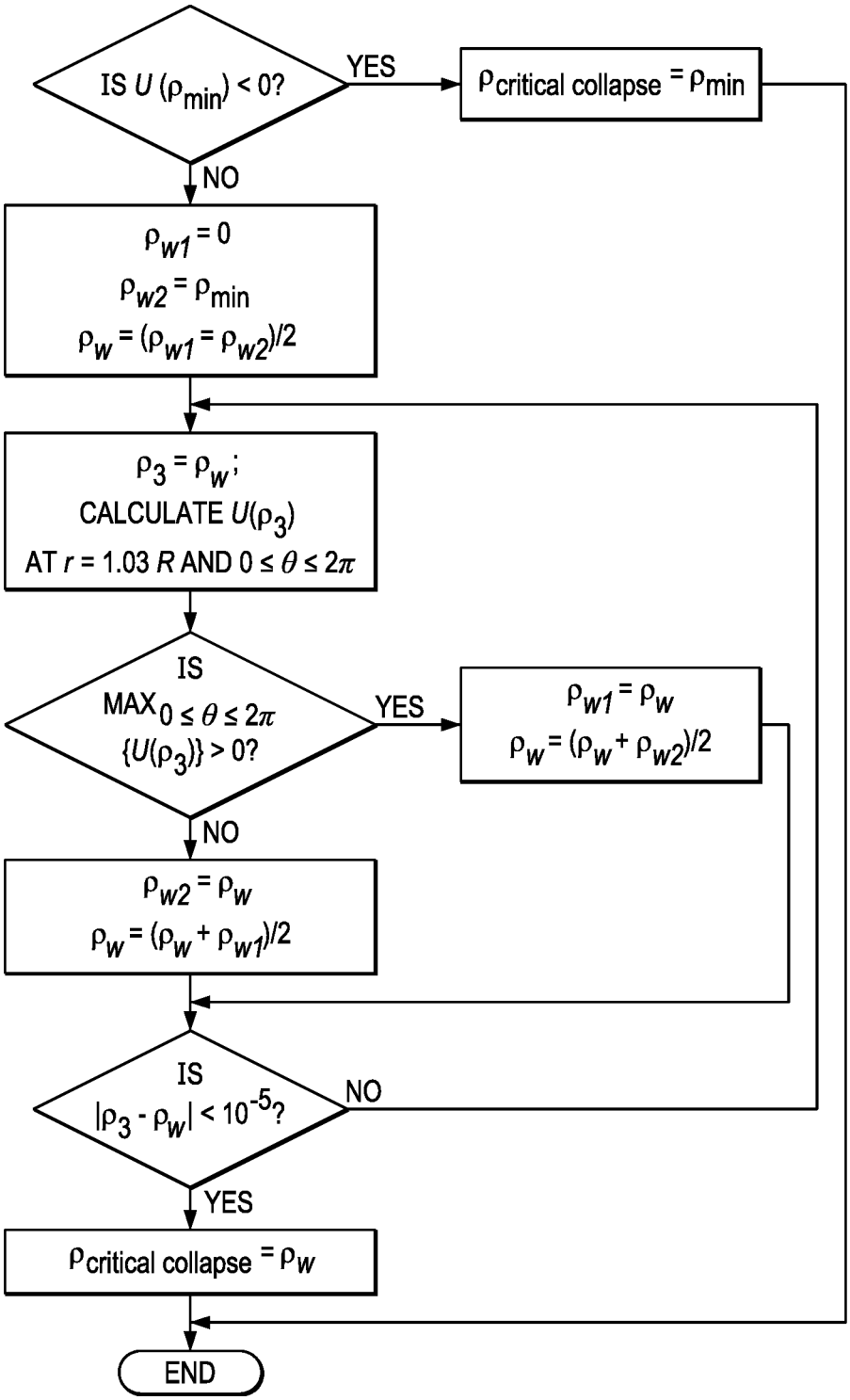

FIG. 7 is a flowchart of an example method 700 for determining a time-dependent mud weight window for a drilling operation. At 702, a rock type of a formation in which a wellbore is to be drilled is determined along with whether fractures are present in the formation rock, such as natural fractures. The rock type and fracture nature of the formation may be determined, for example, using gramma ray logging data or image logging data, or both. Other types of data that may be used to determine rock type and the existence of fractures within formation rock may also be used. Determining a rock type and fracture nature of a formation may result in determining whether the formation rock is a conventional rock type or an unconventional rock type or whether natural fractures exist in the formation rock. At 704, a drained solution or undrained solution is selected based on the determined rock type. At 706, a poroelastic model or dual-poroelastic model is selected based on whether the formation rock includes fractures. For example, if the formation rock does not include fractures, such as natural fractures, the poroelastic model is selected. On the other hand, if fractures are detected in the formation rock, a dual-poroelastic model is selected. At 708, a combined solution is selected based on the selected drained or undrained solution and the selected poroelastic or dual-poroelastic model. At 710, in-situ stresses, pore pressure, and mechanical properties of the formation rock are determined. In-situ stresses, pore pressure, and mechanical properties of the formation rock may be determined, for example, using density log data, resistivity log data, and SP log data. Other types of data that may be used to determine in-situ stresses, pore pressure, and mechanical properties of the formation rock may also be used.

At 712, wellbore trajectory parameters (e.g., wellbore inclination angle, wellbore azimuth, true vertical depth, and wellbore radius used to rotate the in-situ stresses into the wellbore coordinates), the determined in-situ stresses, pore pressure, and mechanical properties of the formation rock are applied to the combined solution to determine effective stresses by the application of equation 14. At 714, the determined effective stresses are combined with a shear failure criterion and a tensile failure criterion to calculate mud weight window. Various shear failure criterion can be used. In the illustrated approach, the Drucker-Prager criterion is used as an example. For example, the algorithm in FIGS. 8A and 8B was then used to determine the mud weight window. At 716, a weight of mud used in a drilling operation is controlled based on the mud weight window. In some implementations, control of the weight of mud is automatically controlled using a computer of a type described later.

Figure 9:
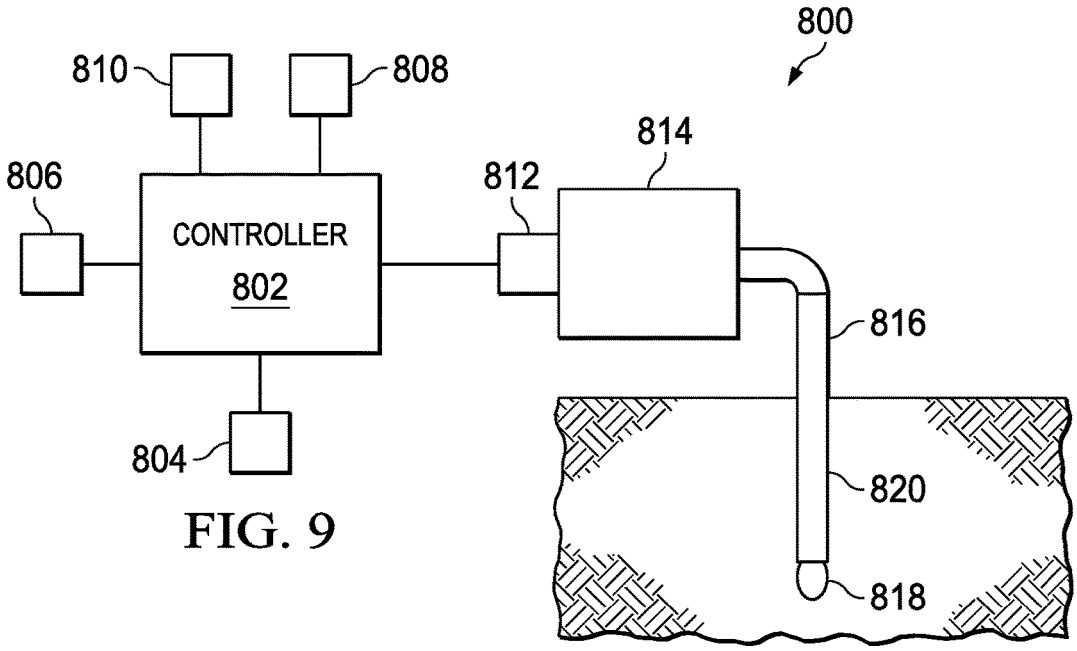
FIG. 9 is an example system for use in adjusting mud weight according to a mud weight window, according to some implementations of the present disclosure.

FIG. 9 is an example system 800 for use in adjusting mud weight according to a mud weight window determined according to methods within the scope of the present disclosure. The system includes a controller 802. The controller 802 may be a computer of a type as described later. The controller 802 includes a display 804, such as a liquid crystal display, a cathode ray tube, or some other type of display device, for displaying information, and an input device 806, such as a keyboard, mouse, or some other type of input device. The controller 802 receives data, such as gamma ray log data, image log data, density log data, resistivity log data, and SP log data from a database 808, data acquisition equipment 810, a combination of these, or from another source. In some implementations, the database 808 may form part of the controller 802. The controller 802 utilizes the received data to determine the mud weight window, as described in the present disclosure (for example, as described in the context of the method of FIG. 7) and provides control signals to an actuator 812 coupled to drilling mud producing equipment 814. Based on the mud weight window determined by the controller 802, the controller 802 operates the actuator 812 to increase or decrease a density of the drilling mud. The drilling mud producing equipment 814 is coupled to a drilling string 816 and provides drilling mud to the drilling string 816 during the course of a wellbore drilling operation. The drilling string 816 includes a drill bit 818 that forms wellbore 820 during a wellbore drilling operation.

Figure 10:
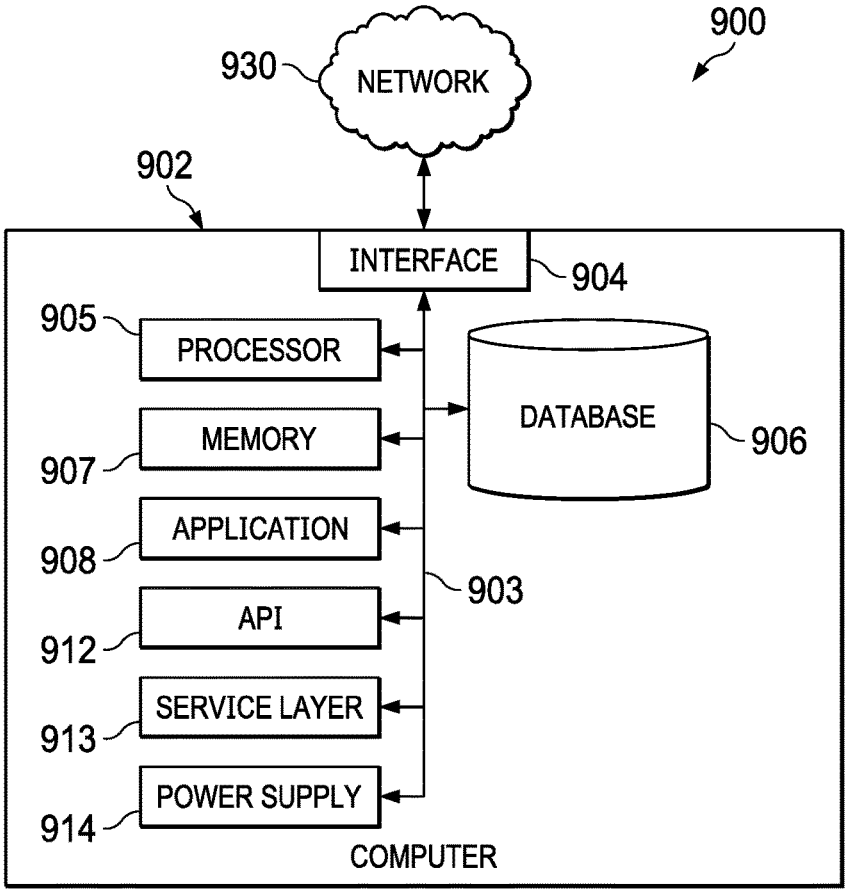
FIG. 10 is a block diagram illustrating an example computer system used to provide computational functionalities associated with described algorithms, methods, functions, processes, flows, and procedures as described in the present disclosure, according to some implementations of the present disclosure.

FIG. 10 is a block diagram of an example computer system 900 used to provide computational functionalities associated with described algorithms, methods, functions, processes, flows, and procedures described in the present disclosure, according to some implementations of the present disclosure. The illustrated computer 902 is intended to encompass any computing device such as a server, a desktop computer, a laptop/notebook computer, a wireless data port, a smart phone, a personal data assistant (PDA), a tablet computing device, or one or more processors within these devices, including physical instances, virtual instances, or both. The computer 902 can include input devices such as keypads, keyboards, and touch screens that can accept user information. Also, the computer 902 can include output devices that can convey information associated with the operation of the computer 902. The information can include digital data, visual data, audio information, or a combination of information. The information can be presented in a graphical user interface (UI) (or GUI).

The computer 902 can serve in a role as a client, a network component, a server, a database, a persistency, or components of a computer system for performing the subject matter described in the present disclosure. The illustrated computer 902 is communicably coupled with a network 930. In some implementations, one or more components of the computer 902 can be configured to operate within different environments, including cloud-computing-based environments, local environments, global environments, and combinations of environments.

At a high level, the computer 902 is an electronic computing device operable to receive, transmit, process, store, and manage data and information associated with the described subject matter. According to some implementations, the computer 902 can also include, or be communicably coupled with, an application server, an email server, a web server, a caching server, a streaming data server, or a combination of servers.

The computer 902 can receive requests over network 930 from a client application (for example, executing on another computer 902). The computer 902 can respond to the received requests by processing the received requests using software applications. Requests can also be sent to the computer 902 from internal users (for example, from a command console), external (or third) parties, automated applications, entities, individuals, systems, and computers.

Each of the components of the computer 902 can communicate using a system bus 903. In some implementations, any or all of the components of the computer 902, including hardware or software components, can interface with each other or the interface 904 (or a combination of both), over the system bus 903. Interfaces can use an application programming interface (API) 912, a service layer 913, or a combination of the API 912 and service layer 913. The API 912 can include specifications for routines, data structures, and object classes. The API 912 can be either computer-language independent or dependent. The API 912 can refer to a complete interface, a single function, or a set of APIs.

The service layer 913 can provide software services to the computer 902 and other components (whether illustrated or not) that are communicably coupled to the computer 902. The functionality of the computer 902 can be accessible for all service consumers using this service layer. Software services, such as those provided by the service layer 913, can provide reusable, defined functionalities through a defined interface. For example, the interface can be software written in a programming language (for example, JAVA™, C++, or a language providing data in extensible markup language (XML) format. While illustrated as an integrated component of the computer 902, in alternative implementations, the API 912 or the service layer 913 can be stand-alone components in relation to other components of the computer 902 and other components communicably coupled to the computer 902. Moreover, any or all parts of the API 912 or the service layer 913 can be implemented as child or sub-modules of another software module, enterprise application, or hardware module without departing from the scope of the present disclosure.

The computer 902 includes an interface 904. Although illustrated as a single interface 904 in FIG. 9, two or more interfaces 904 can be used according to particular needs, desires, or particular implementations of the computer 902 and the described functionality. The interface 904 can be used by the computer 902 for communicating with other systems that are connected to the network 930 (whether illustrated or not) in a distributed environment. Generally, the interface 904 can include, or be implemented using, logic encoded in software or hardware (or a combination of software and hardware) operable to communicate with the network 930. More specifically, the interface 904 can include software supporting one or more communication protocols associated with communications. As such, the network 930 or the interface's hardware can be operable to communicate physical signals within and outside of the illustrated computer 902.

The computer 902 includes a processor 905. Although illustrated as a single processor 905 in FIG. 9, two or more processors 905 can be used according to particular needs, desires, or particular implementations of the computer 902 and the described functionality. Generally, the processor 905 can execute instructions and can manipulate data to perform the operations of the computer 902, including operations using algorithms, methods, functions, processes, flows, and procedures as described in the present disclosure.

The computer 902 also includes a database 906 that can hold data for the computer 902 and other components connected to the network 930 (whether illustrated or not). For example, database 906 can be an in-memory, conventional, or a database storing data consistent with the present disclosure. In some implementations, database 906 can be a combination of two or more different database types (for example, hybrid in-memory and conventional databases) according to particular needs, desires, or particular implementations of the computer 902 and the described functionality. Although illustrated as a single database 906 in FIG. 9, two or more databases (of the same, different, or combination of types) can be used according to particular needs, desires, or particular implementations of the computer 902 and the described functionality. While database 906 is illustrated as an internal component of the computer 902, in alternative implementations, database 906 can be external to the computer 902.

The computer 902 also includes a memory 907 that can hold data for the computer 902 or a combination of components connected to the network 930 (whether illustrated or not). Memory 907 can store any data consistent with the present disclosure. In some implementations, memory 907 can be a combination of two or more different types of memory (for example, a combination of semiconductor and magnetic storage) according to particular needs, desires, or particular implementations of the computer 902 and the described functionality. Although illustrated as a single memory 907 in FIG. 9, two or more memories 907 (of the same, different, or combination of types) can be used according to particular needs, desires, or particular implementations of the computer 902 and the described functionality. While memory 907 is illustrated as an internal component of the computer 902, in alternative implementations, memory 907 can be external to the computer 902.

The application 908 can be an algorithmic software engine providing functionality according to particular needs, desires, or particular implementations of the computer 902 and the described functionality. For example, application 908 can serve as one or more components, modules, or applications. Further, although illustrated as a single application 908, the application 908 can be implemented as multiple applications 908 on the computer 902. In addition, although illustrated as internal to the computer 902, in alternative implementations, the application 908 can be external to the computer 902.

The computer 902 can also include a power supply 914. The power supply 914 can include a rechargeable or non-rechargeable battery that can be configured to be either user- or non-user-replaceable. In some implementations, the power supply 914 can include power-conversion and management circuits, including recharging, standby, and power management functionalities. In some implementations, the power-supply 914 can include a power plug to allow the computer 902 to be plugged into a wall socket or a power source to, for example, power the computer 902 or recharge a rechargeable battery.

There can be any number of computers 902 associated with, or external to, a computer system containing computer 902, with each computer 902 communicating over network 930. Further, the terms "client," "user," and other appropriate terminology can be used interchangeably, as appropriate, without departing from the scope of the present disclosure. Moreover, the present disclosure contemplates that many users can use one computer 902 and one user can use multiple computers 902.

Described implementations of the subject matter can include one or more features, alone or in combination.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. The example, the signal can be a machine-generated electrical, optical, or electromagnetic signal that is generated to encode information for transmission to suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatus, devices, and machines for processing data, including by way of example, a programmable processor, a computer, or multiple processors or computers. The apparatus can also include special purpose logic circuitry including, for example, a central processing unit (CPU), a field programmable gate array (FPGA), or an application specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example, LINUX®, UNIX®, WINDOWS®, MAC OS®, ANDROID®, or IOS®.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as standalone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory. A computer can also include, or be operatively coupled to, one or more mass storage devices for storing data. In some implementations, a computer can receive data from, and transfer data to, the mass storage devices including, for example, magnetic, magneto optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer readable media (transitory or non-transitory, as appropriate) suitable for storing computer program instructions and data can include all forms of permanent/non-permanent and volatile/nonvolatile memory, media, and memory devices. Computer readable media can include, for example, semiconductor memory devices such as random access memory (RAM), read only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer readable media can also include, for example, magnetic devices such as tape, cartridges, cassettes, and internal/removable disks. Computer readable media can also include magneto optical disks and optical memory devices and technologies including, for example, digital video disc (DVD), CD ROM, DVD+/−R, DVD-RAM, DVD-ROM, HD-DVD, and BLU-RAY™. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated in, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback including, for example, sensory feedback including visual feedback, auditory feedback, or tactile feedback. Input from the user can be received in the form of acoustic, speech, or tactile input. In addition, a computer can interact with a user by sending documents to, and receiving documents from, a device that is used by the user. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

A number of embodiments of the present disclosure have been described.

Nevertheless, it will be understood that various modifications may be made without departing from the spirit and scope of the present disclosure. Accordingly, other embodiments are within the scope of the following claims.

What is claimed is:

1. A computer-implemented method performed by one or more processors for automatically controlling a drilling mud weight, the method comprising the following operations:

determining a rock type of a formation rock and the presence of fractures in the formation rock;

selecting a drained solution or undrained solution based on the determined rock type and fracture nature of the formation rock;

selecting a poroelastic model or dual-poroelastic model based on whether the formation rock includes fractures;

selecting a combined solution based on the selected drained or undrained solution and the selected poroelastic or dual-poroelastic model by selecting, when the dual-poroelastic and the undrained solution is selected, an axial stress component ($\sigma_{zz}$) of the combined solution as:

$$\sigma_{zz}=\sigma_{zz}^{elastic}+(1-2*\nu)*[\alpha_1*(p_1-p_0)+2*\alpha_2*(p_2-p_0)],$$

where: $\sigma_{zz}^{elastic}$ is an axial stress component of the elastic solutions, $\nu$ is a Poisson's ratio of the formation rock, $\alpha_1$ is a Biot number of a formation rock matrix of the formation rock, $\alpha_2$ is a Biot number of formation rock fractures of the formation rock, $p_0$ is an initial pore pressure, $p_1$ is a pore pressure of the formation rock matrix, and $p_2$ is a pore pressure of the formation rock fractures, wherein the selected combined solution is a function of elastic solutions;

determining in-situ stresses, pore pressure, and mechanical properties of the formation rock;

applying wellbore trajectory parameters, the determined in-situ stresses, pore pressure, and mechanical properties of the formation rock to the selected combined solution to determine effective stresses;

calculating a mud weight window by combining the determined effective stresses with a shear failure criterion and a tensile failure criterion; and controlling a weight of mud used in a drilling operation based on the mud weight window.

2. The computer-implemented method of claim 1, wherein selecting the drained solution or undrained solution based on the determined rock type and fracture nature of the formation rock comprises selecting the drained solution when the rock type of the formation rock is determined to be a conventional rock type.

3. The computer-implemented method of claim 1, wherein selecting the drained solution or undrained solution based on the determined rock type and fracture nature of the formation rock comprises selecting the undrained solution when the rock type of the formation rock is determined to be an unconventional rock type.

4. The computer-implemented method of claim 1, wherein selecting the poroelastic model or dual-poroelastic model based on whether the formation rock includes fractures comprises selecting the poroelastic model when fractures are determined to be absent from the formation rock.

5. The computer-implemented method of claim 1, wherein selecting the poroelastic model or dual-poroelastic model based on whether the formation rock includes fractures comprises selecting the dual-poroelastic model when fractures are determined to be present in the formation rock.

6. The computer-implemented method of claim 1, wherein calculating the mud weight window comprises using a Drucker-Prager criterion to determine the mud weight window.

7. The computer-implemented method of claim 1, wherein the selected combined solution includes at least one of a radial stress component or a tangential stress component that is a function of a Biot number of the formation rock.

8. The computer-implemented method of claim 7, wherein the function of the Biot number includes the Biot number multiplied by a pressure.

9. The computer-implemented method of claim 1, wherein the selected combined solution is independent of a permeability of the formation rock.

10. The computer-implemented method of claim 9, wherein the elastic solutions are (i) a function of the in-situ stresses and (ii) a function of a radius.

11. The computer-implemented method of claim 1, wherein selecting the combined solution based on the selected drained or undrained solution and the selected poroelastic or dual-poroelastic model comprises selecting, when the dual-poroelastic and the undrained solution is selected, (i) a radial stress component of the combined solution to be equal to a radial stress component of the elastic solutions, and (ii) a tangential stress component of the combined solution to be equal to a circumferential stress component of the elastic solutions.

12. The computer-implemented method of claim 1, wherein selecting the combined solution based on the selected drained or undrained solution and the selected poroelastic or dual-poroelastic model comprises selecting, when the poroelastic and the undrained solution is selected, all stress components of the combined solution to be equal to respective stress components of the elastic solutions.

13. The computer-implemented method of claim 1, wherein selecting the combined solution based on the selected drained or undrained solution and the selected poroelastic or dual-poroelastic model comprises selecting, when the poroelastic and the drained solution is selected, the axial stress component ($\sigma_{zz}$) of the combined solution as:

$$\sigma_{zz}=\sigma_{zz}^{elastic}+(1-2*\nu)/(1-\nu)*\alpha*(p_w-p_0);$$

where: $\sigma_{zz}^{elastic}$ is the axial stress component of the elastic solutions, $\nu$ is the Poisson's ratio of the formation rock, $\alpha$ is a Biot number of the formation rock, $p_0$ is the initial pore pressure, and $p_w$ is a pore pressure.

14. The computer-implemented method of claim 13, wherein selecting the combined solution based on the selected drained or undrained solution and the selected poroelastic or dual-poroelastic model comprises selecting, when the poroelastic and the drained solution is selected, a radial stress component ($\sigma_{rr}$) of the combined solution as:

$$\sigma_{rr}=\sigma_{rr}^{elastic}+(1-2*\nu)/(2*(1-\nu))*\alpha*(p_w-p_0)*(1-R^2/r^2);$$

where: $\sigma_{rr}^{elastic}$ is a radial stress component of the elastic solutions, $\nu$ is the Poisson's ratio of the formation rock, $\alpha$ is the Biot number of the formation rock, $p_0$ is the initial pore pressure, $p_w$ is the pore pressure, R is a radius, and r is a selected radial distance.

15. The computer-implemented method of claim 14, wherein selecting the combined solution based on the selected drained or undrained solution and the selected poroelastic or dual-poroelastic model comprises selecting, when the poroelastic and the drained solution is selected, a tangential stress component ($\sigma_{\theta\theta}$) of the combined solution as:

$$\sigma_{\theta\theta}=\sigma_{\theta\theta}^{elastic}+(1-2*\nu)/(2*(1-\nu))*\alpha*(p_w-p_0)*(1-R^2/r^2);$$

where: $\sigma_{\theta\theta}^{elastic}$ is a tangential stress component of the elastic solutions, $\nu$ is the Poisson's ratio of the formation rock, $\alpha$ is the Biot number of the formation rock, $p_0$ is the initial pore pressure, $p_w$ is the pore pressure, R is the radius, and r is the selected radial distance.

16. A method for controlling a drilling mud weight comprises:

drilling a wellbore to determine a rock type of a formation rock and the presence of fractures in the formation rock;

selecting a drained solution or undrained solution based on the determined rock type and fracture nature of the formation rock;

selecting a poroelastic model or dual-poroelastic model based on whether the formation rock includes fractures;

selecting a combined solution based on the selected drained or undrained solution and the selected poroelastic or dual-poroelastic model by selecting, when the dual-poroelastic and the undrained solution is selected, an axial stress component ($\sigma_{zz}$) of the combined solution as:

$$\sigma_{zz}=\sigma_{zz}^{elastic}+(1-2*\nu)*[\alpha_1*(p_1-p_0)+2*\alpha_2*(p_2-p_0)],$$

where: $\sigma_{zz}^{elastic}$ is an axial stress component of the elastic solutions, $\nu$ is a Poisson's ratio of the formation rock, $\alpha_1$ is a Biot number of a formation rock matrix of the formation rock, $\alpha_2$ is a Biot number of formation rock fractures of the formation rock, $p_0$ is an initial pore pressure, $p_1$ is a pore pressure of the formation rock matrix, and $p_2$ is a pore pressure of the formation rock fractures, wherein the selected combined solution is a function of elastic solutions;

determining in-situ stresses, pore pressure, and mechanical properties of the formation rock;

applying wellbore trajectory parameters, the determined in-situ stresses, pore pressure, and mechanical properties of the formation rock to the selected combined solution to determine effective stresses;

calculating a mud weight window by combining the determined effective stresses with a shear failure criterion and a tensile failure criterion; and controlling a weight of mud used in a drilling operation based on the mud weight window.

17. The method of claim 16, wherein selecting the drained solution or undrained solution based on the determined rock type and fracture nature of the formation rock comprises selecting the drained solution when the rock type of the formation rock is determined to be a conventional rock type.

18. The method of claim 16, wherein selecting the drained solution or undrained solution based on the determined rock type and fracture nature of the formation rock comprises selecting the undrained solution when the rock type of the formation rock is determined to be an unconventional rock type.

19. The method of claim 16, wherein selecting the poroelastic model or dual-poroelastic model based on whether the formation rock includes fractures comprises selecting the poroelastic model when fractures are determined to be absent from the formation rock.

20. The method of claim 16, wherein selecting the poroelastic model or dual-poroelastic model based on whether the formation rock includes fractures comprises selecting the dual-poroelastic model when fractures are determined to be present in the formation rock.

21. The method of claim 16, wherein calculating the mud weight window comprises using a Drucker-Prager criterion to determine the mud weight window.

22. The method of claim 16, wherein the selected combined solution includes at least one of a radial stress component or a tangential stress component that is a function of a Biot number of the formation rock.

23. The method of claim 22, wherein the function of the Biot number includes the Biot number multiplied by a pressure.

24. The method of claim 16, wherein the selected combined solution is independent of a permeability of the formation rock.

25. The method of claim 24, wherein the elastic solutions are (i) a function of the in-situ stresses and (ii) a function of a radius.

* * * * *